US007885425B2

(12) United States Patent
Matsumura et al.

(10) Patent No.: US 7,885,425 B2
(45) Date of Patent: Feb. 8, 2011

(54) ELECTRODYNAMIC ELECTROACOUSTIC TRANSDUCER AND ELECTRONIC DEVICE

(75) Inventors: Toshiyuki Matsumura, Osaka (JP); Shuji Saiki, Nara (JP); Sawako Kano, Hyogo (JP); Koji Sano, Mie (JP)

(73) Assignee: Panasonic Corporation, Osaka (JP)

( * ) Notice: Subject to any disclaimer, the term of this patent is extended or adjusted under 35 U.S.C. 154(b) by 1133 days.

(21) Appl. No.: 11/578,040

(22) PCT Filed: Jan. 26, 2006

(86) PCT No.: PCT/JP2006/301240

§ 371 (c)(1),
(2), (4) Date: Oct. 12, 2006

(87) PCT Pub. No.: WO2006/080405

PCT Pub. Date: Aug. 3, 2006

(65) Prior Publication Data

US 2007/0165902 A1 Jul. 19, 2007

(30) Foreign Application Priority Data

Jan. 28, 2005 (JP) ..... 2005-021405
Aug. 3, 2005 (JP) ..... 2005-225016
Sep. 9, 2005 (JP) ..... 2005-262634

(51) Int. Cl.
*H04R 25/00* (2006.01)

(52) U.S. Cl. ..... 381/420; 381/414; 381/421

(58) Field of Classification Search ..... 381/396, 381/398, 399, 400, 401, 408, 412, 414, 420–423, 381/430, 431
See application file for complete search history.

(56) References Cited

U.S. PATENT DOCUMENTS 4,317,965 A 3/1982 Toyoda (Continued)

FOREIGN PATENT DOCUMENTS

EP 1 482 762 12/2004

(Continued)

OTHER PUBLICATIONS

Supplementary European Search Report issued Sep. 27, 2010 in corresponding European Application No. 06 71 2422.

*Primary Examiner*—Huyen D Le
(74) *Attorney, Agent, or Firm*—Wenderoth, Lind & Ponack, L.L.P.

(57) ABSTRACT

An electrodynamic electroacoustic transducer comprises: a first magnetic pole; a second magnetic pole that forms a magnetic gap between itself and the first magnetic pole and is arranged in a space excluding spaces in upper and lower face directions of the first magnetic pole; a yoke; a diaphragm; and a voice coil. The yoke magnetically couples one magnetic pole face of the first magnetic pole with one magnetic pole face of the second magnetic pole so as to support them. The diaphragm is arranged in a space in an upper face direction of the first magnetic pole and in a space in a lower face direction of the second magnetic pole, while its outer periphery is supported by the yoke. The voice coil is arranged in the magnetic gap and adhered to the diaphragm. At least one of the first magnetic pole part and the second magnetic pole part includes a magnet.

12 Claims, 21 Drawing Sheets

U.S. PATENT DOCUMENTS

| | | | | |
|---|---|---|---|---|
| 4,752,963 | A * | 6/1988 | Yamazaki et al. | 381/430 |
| 6,035,052 | A * | 3/2000 | Fujihira et al. | 381/401 |

FOREIGN PATENT DOCUMENTS

| | | | |
|---|---|---|---|
| EP | 1 589 782 | A1 | 10/2005 |
| JP | 55-135500 | | 10/1980 |
| JP | 5-34797 | | 5/1993 |
| JP | 10-276490 | | 10/1998 |
| JP | 2000-152378 | | 5/2000 |
| JP | 2004-32659 | | 1/2004 |
| JP | 2004-266337 | | 9/2004 |
| JP | 2006-173997 | | 6/2006 |

* cited by examiner

ELECTRODYNAMIC ELECTROACOUSTIC TRANSDUCER AND ELECTRONIC DEVICE

TECHNICAL FIELD

The present invention relates to an electrodynamic electroacoustic transducer and an electronic device and, in particular, to an electrodynamic electroacoustic transducer which is installed in an electronic device such as a portable telephone, a PDA (Personal digital assistant) a television receiver, a personal computer, a car navigation device, and a portable player and thereby reproduces an acoustic signal as well as to an electronic device in which the same is installed.

BACKGROUND ART

In the conventional art, in electronic devices such as portable telephones and PDAs, thickness reduction and power consumption reduction are advanced. In association with this, further size reduction and further efficiency improvement are desired also in electroacoustic transducers installed in these devices. The most general technique for improving the efficiency in an electroacoustic transducer is to increase the volume of the magnet. Nevertheless, the increase in the volume of the magnet causes an increase in the volume of the electroacoustic transducer itself. Thus, in order to realize size reduction and efficiency improvement, an electrodynamic electroacoustic transducer 200 shown in FIG. 39 is proposed (see, for example, Patent Document 1). Here, FIG. 39 is a structure sectional view of an electrodynamic electroacoustic transducer 200 according to the conventional art.

In FIG. 39, the electrodynamic electroacoustic transducer 200 comprises a first magnet 211, a first yoke 212, a second magnet 213, a second yoke 214, a diaphragm 215, a voice coil 216, and a housing 217.

The first magnet 211 and the second magnet 213 are arrange such as to oppose the both sides of the diaphragm 215 and face each other with the diaphragm 215 in between. A magnetic gap is formed between the first magnet 211 and the second magnet 213. Further, the surfaces opposite to the surfaces opposing the diaphragm 215 in the first magnet 211 and the second magnet 213 are fixed to the first yoke 212 and the second yoke 214, respectively. Furthermore, the first magnet 211 and the second magnet 213 are magnetized such that the polarities should be opposite in the vibrating directions of the diaphragm 215.

The first yoke 212 has a shape such as to surround a surface excluding the surface opposing the diaphragm 215 of the first magnet 211. Similar, the second yoke 214 has a shape such as to surround a surface excluding the surface opposing the diaphragm 215 of the second magnet 213. Further, the first yoke 212 and the second yoke 214 are fixed respectively to the inside of the housing 217.

The diaphragm 215 is fixed to the inside of the housing 217 which has sound holes, and is arranged to be located in surrounded by the first magnet 211, the second magnet 213, and the housing 217. The voice coil 216 is adhered to the diaphragm 215 and is arranged in the magnetic gap. The operation of the electrodynamic electroacoustic transducer 200 is described below.

The first magnet 211 and the second magnet 213 are magnetized in the opposite directions, and arranged in a manner opposing each other. Thus, the magnetic fluxes each emitted from each magnet toward the diaphragm repel each other. Thus, each magnetic flux vector bends almost perpendicularly inside the above-mentioned magnetic gap, and thereby forms a curve directing to the yoke to which each magnet is adhered. Thus, at the position of the voice coil 216 (the voice coil position, hereinafter), a magnetic field is formed that is composed of a magnetic flux perpendicular to the vibrating directions of the diaphragm 215. When a current signal flows through the voice coil 216 arranged on this magnetic flux, a driving force is generated that is proportional to the product between the magnitude of the current and the magnetic flux density at the voice coil position. Then, by virtue of the driving force, the diaphragm 215 vibrates and emits sound.

A general electrodynamic electroacoustic transducer is constructed such that the thickness of the voice coil is thick in the vibrating directions of the diaphragm. In contrast, this conventional art example is constructed such that the thickness of the voice coil 216 is thin in the plane direction of the diaphragm 215. Thus, the overall thickness of the electrodynamic electroacoustic transducer 200 can be made thinner than the conventional art electroacoustic transducer.

Here, in general, in an electrodynamic electroacoustic transducer, when the vibrating part of the diaphragm contacts with a part other than the diaphragm of the transducer, allophone is generated. Thus, design is performed such that even when the maximum sound pressure desired in the transducer is reproduced, the vibrating part of the diaphragm should not contact with any part other than the diaphragm of the transducer. In the structure of the electrodynamic electroacoustic transducer 200 described above, in order that the vibrating part of the diaphragm 215 should not contact with the first magnet 211, the second magnet 213, the first yoke 212, and the second yoke 214 at the time of the maximum amplitude of the diaphragm 215, the distance between each and the diaphragm 215, that is, an amplitude margin, need be ensured sufficiently. Thus, in the structure of the electrodynamic electroacoustic transducer 200 described above, the thickness obtained by adding the thicknesses of the two magnetic circuits (a magnetic circuit constructed from the first magnet 211 and the first yoke 212 and a magnetic circuit constructed from the second magnet 213 and the second yoke 214) and the amplitude margins on the both sides of the diaphragm 215 has been the minimum thickness for the electrodynamic electroacoustic transducer 200.

Further, as an example of an electromagnetic induction type electroacoustic transducer according to the conventional art, an electromagnetic induction type electroacoustic transducer 300 as shown in FIG. 40 is proposed in order to achieve size reduction and efficiency improvement (see, for example, Patent Document 2). Here, FIG. 40 is a structure sectional view of an electromagnetic induction type electroacoustic transducer 300 according to the conventional art.

In FIG. 40, the electromagnetic induction type electroacoustic transducer 300 comprises a magnet 311, a plate 312, a yoke 313, a driving primary coil 314, a diaphragm 315, and a secondary coil 316.

The magnet 311 is fixed on the center axis of the yoke 313 having sound holes. The plate 312 is adhered to the upper face of the magnet 311. The driving primary coil 314 is located on the front face side of the electromagnetic induction type electroacoustic transducer 300 relative to the magnet 311 and the plate 312. Further, the driving primary coil 314, the magnet 311, and the plate 312 are arranged such that the center axes should agree with each other.

The magnet 311 and the driving primary coil 314 are fixed to the yoke 313. The secondary coil 316 is adhered to the diaphragm 315 such as to be located in a magnetic gap formed between the magnet 311 plus the plate 312 and a part of the yoke 313 to which the driving primary coil 314 is fixed. Here, the dimension of the above-mentioned magnetic gap is formed uniformly. The inner periphery of the secondary coil 316 is smaller than the outer periphery of the magnet 311. Further, the outer periphery of the secondary coil 316 is larger than the inner periphery of the driving primary coil 314. Here, the driving primary coil 314 is also fixed to the yoke 313 such as to be located in the above-mentioned magnetic gap. The diaphragm 315 is fixed to the yoke 313 via the edge. The operation of the electromagnetic induction type electroacoustic transducer 300 is described below.

In the electromagnetic induction type electroacoustic transducer 300, when a current flows through the driving primary coil 314, an induction magnetic field is generated that has a magnitude proportional to the time differential of the change of the current. Then, a current is generated in the secondary coil 316 by virtue of the induction magnetic field. In the secondary coil 316, a driving force is generated that is proportional to the product between the current flowing through the secondary coil 316 and the magnetic flux density at the position of the secondary coil 316. By virtue of the driving force, the diaphragm 315 vibrates and thereby emits sound.

In this electromagnetic induction type electroacoustic transducer, in general, the driving primary coil 314 need be arranged in the above-mentioned magnetic gap. This causes an increase in the magnetic gap length by the amount of the driving primary coil 314, and hence reduces the magnetic flux density in the magnetic gap. Thus, a problem arises that the performance is degraded. Thus, in the electromagnetic induction type electroacoustic transducer 300, the magnetic flux is generated in an oblique direction on the front face side relative to the center axis of the diaphragm 315, so that the thickness of the driving primary coil 314 is reduced, so that the magnetic gap length is reduced. As a result, the magnetic flux density at the position of the secondary coil 316 can be increased.

[Patent Document 1] Japanese Laid-Open Patent Publication No. 2004-32659

[Patent Document 2] Japanese Laid-Open Patent Publication No. H10-276490

DISCLOSURE OF THE INVENTION

Problems to be Solved by the Invention

Nevertheless, in the above-mentioned two conventional art examples, when the thickness of the electroacoustic transducer is to be reduced for the purpose of further thickness reduction and size reduction, the thickness of the magnet need be reduced further, from the perspective of the structure.

In the configuration of the electrodynamic electroacoustic transducer 200 shown in FIG. 39, the first magnet 211, the first yoke 212, the second magnet 213, the second yoke 214, the diaphragm 215, and voice coil 216 are all aligned in the thickness direction of the electrodynamic electroacoustic transducer 200. Thus, in order to reduce the thickness of the entire electrodynamic electroacoustic transducer 200, the thickness of any one of the first magnet 211, the first yoke 212, the second magnet 213, and the second yoke 214 need be reduced. Nevertheless, if the magnet were made thin, the magnetic flux density at the position of the voice coil 216 could be reduced so that the performance would be degraded. Further, a magnet fabricated from neodymium used generally in a small/thin speaker has a property that when the magnet is made thinner, high temperature demagnetization occurs more easily with increasing temperature in the environment of use. This remarkably degrades the reliability as an electrodynamic electroacoustic transducer. That is, there is a limit in reducing the magnet thickness with maintaining the reliability. These reasons have caused difficulty in reducing the thickness of the electrodynamic electroacoustic transducer 200 itself.

Further, the first magnet 211 and the second magnet 213 arranged on both face sides of the diaphragm 215 are magnetized in the opposite directions. This causes the problem of an increase in the number of fabrication process steps in comparison with the cases that a single magnet is magnetized and that a plurality of magnets are magnetized into the same polarity.

On the other hand, in the configuration of the electromagnetic induction type electroacoustic transducer 300 shown in FIG. 40, the magnet 311, the plate 312, the diaphragm 315, the secondary coil 316, the driving primary coil 314, and a part of the yoke 313 to which the driving primary coil 314 is fixed overlap with each other in the thickness direction of the electromagnetic induction type electroacoustic transducer 300. Thus, in order to reduce the thickness of the entire electromagnetic induction type electroacoustic transducer 300 with ensuring an amplitude margin, the thickness of the magnet 311 need be reduced. When the thickness of the magnet 311 were reduced, a problem could arise that the reliability as an electroacoustic transducer is degraded similarly to the electrodynamic electroacoustic transducer 200 described above.

Further, as described above, in the electromagnetic induction type electroacoustic transducer 300, the driving primary coil 314 is present between the plate 312 and the above-mentioned part of the yoke 313 that construct the magnetic gap of uniform dimension. This causes an increase in the distance of the magnetic gap, and hence causes a problem that the magnetic flux density in the magnetic gap becomes lower than in a general electrodynamic electroacoustic transducer. Thus, since the magnetic flux density in the magnetic gap becomes lower than in the electrodynamic type when the thickness of the magnet 311 is reduced, difficulty has been present in the thickness reduction of the electromagnetic induction type electroacoustic transducer 300 itself.

Further, in the electromagnetic induction type, the driving primary coil 314 and the secondary coil 316 are not electromagnetically coupled to each other through a core material serving as a high magnetic permeability magnetic material as in an ordinary transformer (voltage transformer), but coupled through air. Thus, the coupling coefficient is small. This has caused a problem that when the thickness of the magnet 311 is reduced, the efficiency as a transducer becomes still lower. Further, in the electromagnetic induction type, since the induction magnetic field is generated in proportion to the time differential of the current, the electromagnetic induction current is not sufficiently generated at low frequencies. This has caused the problem of difficulty in the reproduction in a low pitch sound range.

Thus, an object of the present invention is to provide: an electrodynamic electroacoustic transducer in which size reduction and thickness reduction can be performed without reducing the thickness of the magnet; and an electronic device in which the electrodynamic electroacoustic transducer is installed.

Solution to the Problems

In order to achieve the above-mentioned object, the present invention has the following features.

A first aspect of the present invention is characterized by an electrodynamic electroacoustic transducer comprising: a first magnetic pole part formed by at least one three-dimensional body; a second magnetic pole part which is formed by at least one three-dimensional body, forms a magnetic gap between itself and the first magnetic pole part, and is arranged in a space excluding spaces in upper and lower face directions of the first magnetic pole part; a yoke for magnetically coupling one magnetic pole face of the first magnetic pole part with one magnetic pole face of the second magnetic pole part so as to support them; a diaphragm which is arranged in a space in an upper face direction of the first magnetic pole part and in a space in a lower face direction of the second magnetic pole part, has an outer periphery supported by the yoke, and can vibrate in up and down directions; and a voice coil adhered to the diaphragm and arranged in the magnetic gap, wherein at least one of the first magnetic pole part and the second magnetic pole part includes a magnet, and wherein the diaphragm includes an edge part that permits vibration of the diaphragm, while at least a part of the edge part opposes a lower face of the second magnetic pole part.

A second aspect of the present invention is characterized in that in the first aspect described above, in the vibrating directions of the diaphragm, the lower face of the second magnetic pole part is located above the upper face of the first magnetic pole part.

A third aspect of the present invention is characterized in that in the first aspect described above, in the vibrating directions of the diaphragm, the lower face of the second magnetic pole part it is located below the upper face of the first magnetic pole part or alternatively in plane with the upper face of the first magnetic pole part.

A fourth aspect of the present invention is characterized in that in the first aspect described above, among the first magnetic pole part and the second magnetic pole part, one magnetic pole part includes a magnet while the other magnetic pole part is a magnetic material not including a magnet, and that a magnetizing direction of the magnet is in the vibrating directions of the diaphragm.

A fifth aspect of the present invention is characterized in that in the first aspect described above, the first magnetic pole part and the second magnetic pole part respectively include a magnet, and that the magnet included in the first magnetic pole part and the magnet included in the second magnetic pole part are magnetized into the same polarity in the vibrating directions of the diaphragm.

A sixth aspect of the present invention is characterized in that in the fifth aspect described above, the first magnetic pole part and the second magnetic pole part are annular bodies in which an open space is formed in a center, and that the first magnetic pole part is arranged in a space in up and down directions of the open space of the annular body that constitutes the second magnetic pole part.

A seventh aspect of the present invention is characterized in that in the fifth aspect described above, the first magnetic pole part is a columnar body, that the second magnetic pole part is an annular body in which an open space is formed in a center, and that the first magnetic pole part is arranged in a space in up and down directions of the open space of the annular body that constitutes the second magnetic pole part.

An eighth aspect of the present invention is characterized in that in the fifth aspect described above, the voice coil has two straight line parts where portions of a winding part face to each other, that the first magnetic pole part includes at least one rectangular parallelepiped having sides each parallel to each of the two straight line parts, that the second magnetic pole part includes two rectangular parallelepipeds each including a magnet, and that in the voice coil, one of the straight line parts is arranged in a magnetic gap formed between one of the second magnetic pole parts and the first magnetic pole part, while the other one of the straight line parts is arranged in a magnetic gap formed between the other one of the second magnetic pole parts and the first magnetic pole part.

A ninth aspect of the present invention is characterized in that in the eighth aspect described above, the first magnetic pole part includes two rectangular parallelepipeds each having sides each parallel to each of the two straight line parts and including a magnet.

A tenth aspect of the present invention is characterized in that in the first aspect described above, in the voice coil, an inner periphery shape is larger than an outer periphery shape of the first magnetic pole part, and that the second magnetic pole part is arranged in a space excluding spaces in up and down directions of the first magnetic pole part and the voice coil.

An eleventh aspect of the present invention is characterized in that in the first aspect described above, at least one of the first magnetic pole part and the second magnetic pole part is constructed from: a plate composed of a magnetic material not including a magnet; and the magnet in which two magnetic pole faces are formed, and that the yoke is coupled to one magnetic pole face of the magnet, while the plate is adhered to the other magnetic pole face of the magnet.

A twelfth aspect of the present invention is characterized in that in the first aspect described above, in the diaphragm, a shape of a part opposing the upper face of the first magnetic pole part is formed in a convex shape relative to the other parts.

A thirteenth aspect of the present invention is characterized in that in the first aspect described above, the voice coil is adhered to either the upper face side or the lower face side of the diaphragm, and that the diaphragm is formed in a shape such that a part opposing the upper face of the first magnetic pole part should be located above a lower end of the voice coil, and that a part opposing the lower face of the second magnetic pole part should be located below an upper end of the voice coil.

A fourteenth aspect of the present invention is characterized in that in the first aspect described above, the diaphragm is formed in a shape selected from a group consisting of a circle, a rectangle, an ellipse, a polygon, and a shape in which two opposing sides in a rectangle or a polygon are solely formed by semicircles.

A fifteenth aspect of the present invention is characterized in that in the first aspect described above, the first magnetic pole part and the second magnetic pole part respectively include a magnet, that the magnet included in the first magnetic pole part is magnetized in the vibrating directions of the diaphragm, and that the magnet included in the second magnetic pole part is magnetized in a direction perpendicular to the vibrating directions of the diaphragm.

A sixteenth aspect of the present invention is characterized in that in the fifteenth aspect described above, the first magnetic pole part and the second magnetic pole part are annular bodies in which an open space is formed in a center, and that the first magnetic pole part is arranged in a space in up and down directions of the open space of the annular body that constitutes the second magnetic pole part.

A seventeenth aspect of the present invention is characterized in that in the fifteenth aspect described above, the first magnetic pole part is a columnar body, that the second magnetic pole part is an annular body in which an open space is formed in a center, and that the first magnetic pole part is arranged in a space in up and down directions of the open space of the annular body that constitutes the second magnetic pole part.

An eighteenth aspect of the present invention is characterized in that in the fifteenth aspect described above, the voice coil has two straight line parts where portions of a winding part face to each other, that the first magnetic pole part includes at least one rectangular parallelepiped having sides each parallel to each of the two straight line parts, that the second magnetic pole part includes two rectangular parallelepipeds each including a magnet, and that in the voice coil, one of the straight line parts is arranged in a magnetic gap formed between one of the second magnetic pole parts and the first magnetic pole part, while the other one of the straight line parts is arranged in a magnetic gap formed between the other one of the second magnetic pole parts and the first magnetic pole part.

A nineteenth aspect of the present invention is characterized in that in the eighteenth aspect described above, the second magnetic pole part includes at least two or more rectangular parallelepipeds each including a magnet.

A twentieth aspect of the present invention is characterized in that in the eighteenth aspect described above, the first magnetic pole part is two rectangular parallelepipeds each having sides each parallel to each of the two straight line parts and including a magnet.

A twenty-first aspect of the present invention is characterized in that in the eighteenth aspect described above, an opening is formed in a part of the yoke including at least a part opposing the second magnetic pole part.

A twenty-second aspect of the present invention is characterized in that in the twenty-first aspect described above, the diaphragm outside the winding part of the voice coil is formed in a state protruding toward the opening side in a part opposing the opening, and is formed in a state protruding toward the opposite side in the other parts.

A twenty-third aspect of the present invention is characterized by an electronic device in which an electrodynamic electroacoustic transducer is installed, wherein the electrodynamic electroacoustic transducer comprises: a first magnetic pole part formed by at least one three-dimensional body; a second magnetic pole part which is formed by at least one three-dimensional body, forms a magnetic gap between itself and the first magnetic pole part, and is arranged in a space excluding spaces in upper and lower face directions of the first magnetic pole part; a yoke for magnetically coupling one magnetic pole face of the first magnetic pole part with one magnetic pole face of the second magnetic pole part so as to support them; a diaphragm which is arranged in a space in an upper face direction of the first magnetic pole part and in a space in a lower face direction of the second magnetic pole part, has an outer periphery supported by the yoke, and can vibrate in up and down directions; and a voice coil adhered to the diaphragm and arranged in the magnetic gap, wherein at least one of the first magnetic pole part and the second magnetic pole part includes a magnet, and wherein the diaphragm includes an edge part that permits vibration of the diaphragm, while at least a part of the edge part opposes a lower face of the second magnetic pole part.

EFFECT OF THE INVENTION

According to the first aspect described above, the structure is such that the first magnetic pole part and the second magnetic pole part do not overlap with each other in the vibrating directions of the diaphragm. Thus, when an electrodynamic electroacoustic transducer is to be implemented that has the same thickness, the magnet included in at least one of the first magnetic pole part and the second magnetic pole part can be constructed thicker in the vibrating directions than in the conventional art. This improves the magnetic flux density at the voice coil position, and hence realizes an electrodynamic electroacoustic transducer of high performance that has the same thickness as the conventional one. Further, in a magnet fabricated from neodymium used generally in a small/thin speaker, high temperature demagnetization occurs more easily for a magnet having a higher energy product. However, when the magnet is made thicker according to this configuration, the permeance coefficient increases so that the magnet becomes resistive against high temperature demagnetization. Thus, with increasing the temperature reliability or alternatively maintaining the same temperature reliability, a magnet having a higher energy product can be employed. This improves further the magnetic flux density at the voice coil position, and hence realizes a small and thin electrodynamic electroacoustic transducer of higher performance. Further, with maintaining the temperature reliability in the conventional art, a thin electrodynamic electroacoustic transducer can be realized that has been impossible according to the conventional art magnetic circuit structure. Further, according to the present invention, an electrodynamic electric sound transducer is adopted so that a driving primary coil is not employed that has caused a reduction in the magnetic flux density in the magnetic gap in the electromagnetic induction type electroacoustic transducer according to the conventional art. Thus, the present invention provides a high performance electroacoustic transducer having the same thickness as the conventional one.

According to the second aspect described above, the lower face of the second magnetic pole part is located above the upper face of the first magnetic pole part, while a magnetic gap is formed between both magnetic poles. In order to implement a thin electrodynamic electroacoustic transducer, the second magnetic pole part can be arranged in an oblique direction relative to the first magnetic pole part in some cases. However, even in this case, since the magnetic flux in the magnetic gap has a component perpendicular to both of the winding direction and the amplitude direction of the voice coil, the diaphragm can be driven. Thus, an electrodynamic electroacoustic transducer can be implemented that has a thickness reduced in comparison with the conventional art.

According to the third aspect described above, the lower face of the second magnetic pole part is located below the upper face of the first magnetic pole part or alternatively in plane. Thus, when the thickness of the electrodynamic electroacoustic transducer itself is the same, the thicknesses of both magnetic pole parts can be increased in the vibrating directions in comparison with the case that the lower face of the second magnetic pole part is located above the upper face of the first magnetic pole part. This provides an advantage in improving the performance of the electrodynamic electroacoustic transducer.

According to the fourth aspect described above, among the first magnetic pole part and the second magnetic pole part, a magnetic pole part that does not include a magnet can be constructed from a magnetic material such as iron other than a magnet. Thus, cost reduction is expected. Further, the magnetic pole part not including a magnet can be made thin. This provides an advantage in the thickness reduction of the electrodynamic electroacoustic transducer.

According to the fifth aspect described above, the magnets included in the first magnetic pole part and the second magnetic pole part have the same polarity in the vibrating directions of the diaphragm. This allows magnetization to be performed after the assembling of the electrodynamic electroacoustic transducer, and hence provides an advantage in the fabrication in comparison with the case that the two magnets are magnetized in the opposite directions. Further, when magnets are provided in both parts, the magnetic flux density in the gap is increased. This provides an advantage in improving the performance of the electrodynamic electroacoustic transducer.

According to the sixth aspect described above, the first magnetic pole part is an annular body where an open space is formed. The open space provides an effect of allowing sound from the lower face of the diaphragm to escape downward easily. Further, examples of the annular body of the second magnetic pole part include a circle, an ellipse, and a polygonal annular body.

According to the seventh aspect described above, when a magnet of a circle, an ellipse, or a polygonal columnar body is employed in the first magnetic pole part, an advantage in the cost is obtained in comparison with a magnet of an annular body where an open space is formed.

According to the eighth aspect described above, since the straight line parts of the voice coil are arranged in the magnetic gap, a driving force can be obtained in the straight line parts of the voice coil even when the shapes of the voice coil and the diaphragm are, for example, of an elongate rectangular shape or of a running track shape.

According to the ninth aspect described above, the space formed between the two rectangular parallelepipeds allows the sound from the lower face of the diaphragm to escape downward easily.

According to the tenth aspect described above, the structure is such that when vibrating, the voice coil does not contact with the first and the second magnetic pole parts. Thus, This realizes a smaller and thinner electrodynamic electroacoustic transducer, with ensuring a larger amplitude margin.

According to the eleventh aspect described above, a plate composed of a magnetic material other than a magnet is adhered to the magnetic pole face of the magnet. This improves further the magnetic flux density at the voice coil position, and hence realizes a small and thin electrodynamic electroacoustic transducer of higher performance.

According to the twelfth and the thirteenth aspects described above, a shape is realized such that the diaphragm hardly contacts with the first magnetic pole part and the second magnetic pole part at the time of vibration. Thus, the first amplitude that the diaphragm displaces in the direction of the first magnetic pole part and thereby contacts with the upper face of the first magnetic pole part and the second amplitude that the diaphragm displaces in the direction of the second magnetic pole part and thereby contacts with the lower face of the second magnetic pole part can be ensured to be large. That is, for example, when the yoke supports respectively the lower face of the first magnetic pole part and the upper face of the second magnetic pole part, the value obtained by adding the thickness of the yoke for supporting the surfaces, the lengths in the vibrating directions of the first magnetic pole part and the second magnetic pole part, and the first and the second amplitudes described above becomes larger than the thickness of the entire electrodynamic electroacoustic transducer. This realizes a thin electrodynamic electroacoustic transducer of higher performance.

According to the fourteenth aspect described above, when an electrodynamic electroacoustic transducer is selected that has a diaphragm of an appropriate shape in accordance with the space shape inside the housing of an electronic device in which installation is performed, the space inside the housing can be used without uselessness.

According to the fifteenth aspect described above, since the magnet included in the first magnetic pole part and the magnet included in the second magnetic pole part have different magnetizing directions from each other, the magnetic flux can be generated more efficiently at the position of the voice coil. Further, since the magnet included in the second magnetic pole part is magnetized in a direction perpendicular to the vibrating directions of the diaphragm, the yoke need not be fixed to the upper part of the magnet included in the second magnetic pole part. This permits further thickness reduction by the amount of the thickness of the yoke.

According to the sixteenth aspect described above, the first magnetic pole part is an annular body where an open space is formed. The open space provides an effect of allowing sound from the lower face of the diaphragm to escape downward easily. Further, examples of the annular body of the second magnetic pole part include a circle, an ellipse, and a polygonal annular body.

According to the seventeenth aspect described above, when a magnet of a circle, an ellipse, or a polygonal columnar body is employed in the first magnetic pole part, an advantage in the cost is obtained in comparison with a magnet of an annular body where an open space is formed.

According to the eighteenth aspect described above, since the straight line parts of the voice coil are arranged in the magnetic gap, a driving force can be obtained in the straight line parts of the voice coil even when the shapes of the voice coil and the diaphragm are, for example, of an elongate rectangular shape or of a running track shape.

According to the nineteenth aspect described above, the second magnetic pole part includes a plurality of rectangular parallelepipeds each including a magnet. Thus, even a magnetizing direction of the magnet which is difficult to be implemented by a single rectangular parallelepiped can be realized by combining a plurality of rectangular parallelepipeds.

According to the twentieth aspect described above, the space formed between the two rectangular parallelepipeds allows the sound from the lower face of the diaphragm to escape downward easily.

According to the twenty-first aspect described above, the opening formed in the yoke allows the sound from the lower face of the diaphragm to escape downward easily. Further, when the thickness is reduced, a structure is realized that the diaphragm hardly contacts with the yoke.

According to the twenty-second aspect described above, a structure is realized that the diaphragm more hardly contacts with the yoke. This permits further thickness reduction.

Further, according to the electronic device employing the electrodynamic electroacoustic transducer of the present invention, effects similar to those of the electrodynamic electroacoustic transducer described above are obtained.

DESCRIPTION OF THE REFERENCE CHARACTERS

Figure 1:
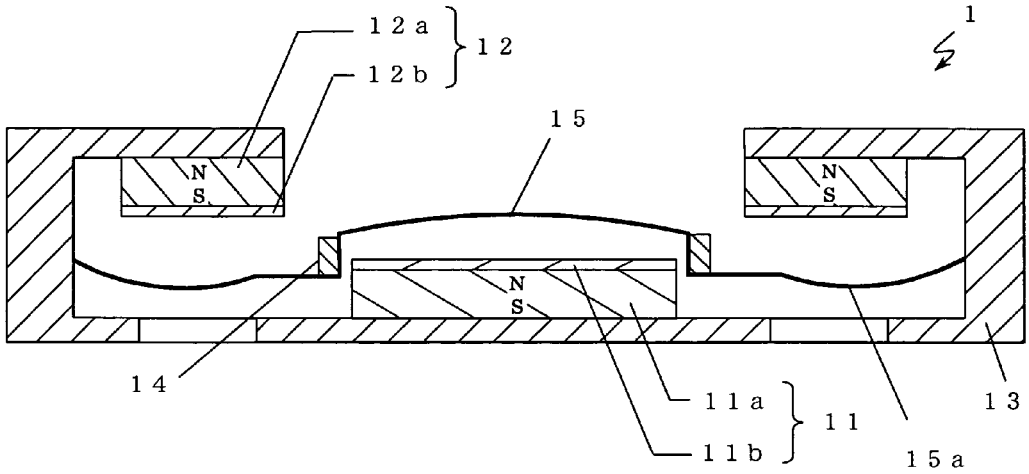
FIG. 1 is a structure sectional view of an electrodynamic electroacoustic transducer 1 according to a first embodiment.

1, 2, 3, 4, 5, 6, 7 electrodynamic electroacoustic transducer
11, 21, 31 first magnetic pole
11*a*, 12*a*, 21*a*, 22*a*, 31*a*, 31*c*, 32*a*, 32*c* magnet
11*b*, 12*b*, 21*b*, 22*b*, 31*b*, 31*d*, 32*b*, 32*d* plate
12, 22, 32 second magnetic pole
13, 23, 33, 43, 53, 63, 73 yoke
14, 24, 34, 44, 54, 64 voice coil
15, 25, 35, 45, 55, 65 diaphragm
41, 51, 61 first magnet
42, 52, 62 second magnet
80 portable telephone
81 flat television receiver
82 door
83 window part
84 main body

BEST MODE FOR CARRYING OUT THE INVENTION

Embodiments of the present invention are described below with reference to the drawings.

First Embodiment

Figure 2:
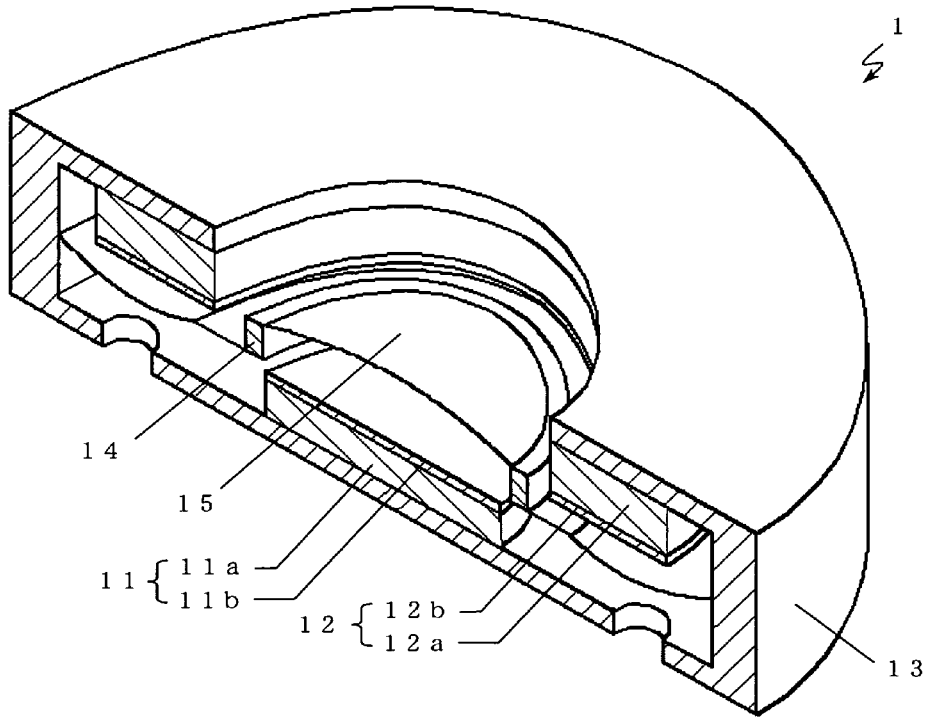
FIG. 2 is a perspective view where a part of an electrodynamic electroacoustic transducer 1 of FIG. 1 is cut off.
Figure 3:
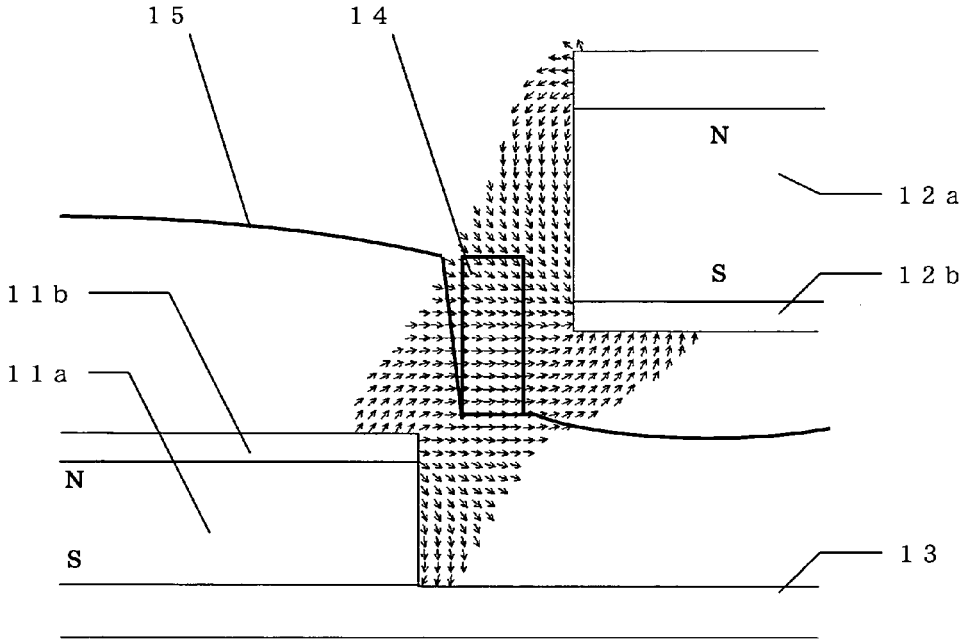
FIG. 3 is a diagram showing the flow of magnetic flux in a vector form, which is obtained in magnetic field analysis by a finite element method performed on an example of a magnetic circuit in an electrodynamic electroacoustic transducer 1 of FIG. 1.
Figure 4:
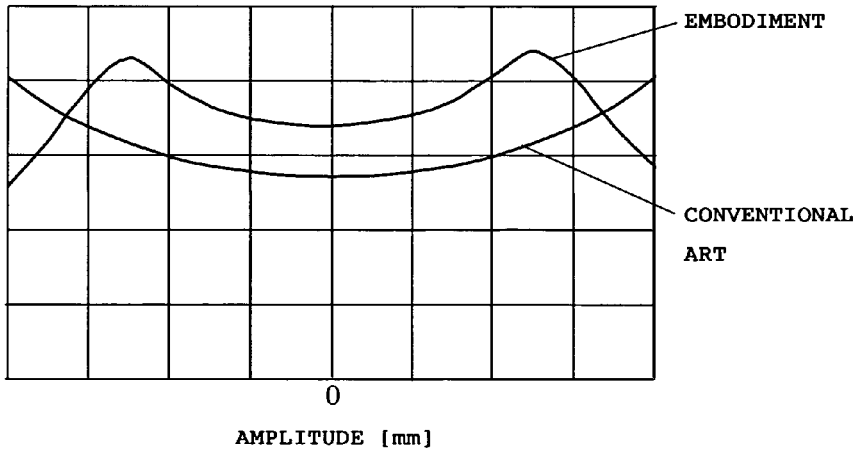
FIG. 4 is a diagram showing a magnetic flux density at a voice coil position compared between a conventional art and a magnetic circuit in an electrodynamic electroacoustic transducer 1 of FIG. 1.

An electrodynamic electroacoustic transducer 1 according to a first embodiment of the present invention is described below with reference to FIGS. 1-4. Here, FIG. 1 is a structure sectional view of an electrodynamic electroacoustic transducer 1 according to a first embodiment. FIG. 2 is a perspective view where a part of the electrodynamic electroacoustic transducer 1 is cut off. FIGS. 3 and 4 are described later. In FIG. 1, the electrodynamic electroacoustic transducer 1 comprises a first magnetic pole 11, a second magnetic pole 12, a yoke 13, a voice coil 14, and a diaphragm 15. Here, as shown in FIG. 2, the shape of the electrodynamic electroacoustic transducer 1 viewed from vibrating directions is a circle. Further, the first magnetic pole 11 corresponds to the first magnetic pole part of the present invention, while the second magnetic pole 12 corresponds to the second magnetic pole part of the present invention.

The first magnetic pole 11 is constructed from a magnet 11*a* and a plate 11*b* that is adhered to the upper face (a magnetic pole face) of the magnet 11*a*. The second magnetic pole 12 is constructed from a magnet 12*a* and a plate 12*b* that is adhered to the lower face (a magnetic pole face) of the magnet 12*a*. The plates 11*b* and 12*b* are composed of magnetic materials (such as iron) other than a magnet. Here, as shown in FIG. 2, the shape of the first magnetic pole 11 is constructed in a circular columnar shape (columnar body), while the shape of the second magnetic pole 12 is constructed by an annular body of a doughnut shape.

Here, the second magnetic pole 12 is located on the front face side of the electrodynamic electroacoustic transducer 1 relative to the first magnetic pole 11. Further, the first magnetic pole 11 and the second magnetic pole 12 are arranged such that the center axes should agree with each other. Further, the inner periphery shape (inner diameter) of the second magnetic pole 12 is larger than the outer periphery shape (outer diameter) of the first magnetic pole 11. Then, the lower face of the second magnetic pole 12 is arranged at the same position as the upper face of the first magnetic pole 11 or alternatively at least on the front face side of the electrodynamic electroacoustic transducer 1 relative to the upper face. That is, the second magnetic pole 12 is located in an oblique front face direction expanding from the first magnetic pole 11, and is arranged such that a magnetic gap should be formed between the first magnetic pole 11 and the second magnetic pole 12. Here, the magnetic gap between the first magnetic pole 11 and the second magnetic pole 12 may be formed, for example, such as to have a uniform dimension across the space where they oppose each other.

The yoke 13 fixes the lower face of the first magnetic pole 11 and the upper face of the second magnetic pole 12, and magnetically couples the first magnetic pole 11 with the second magnetic pole 12 so as to support them. Here, each of the lower face of the first magnetic pole 11 and the upper face of the second magnetic pole 12 corresponds to one magnetic pole face of the present invention. The voice coil 14 has a ring shape and is adhered to the diaphragm 15 so as to be retained in the above-mentioned magnetic gap by the diaphragm 15. Further, the inner periphery shape (inner diameter) of the voice coil 14 is constructed larger than the outer periphery shape (outer diameter) of the first magnetic pole 11. Further, the outer periphery shape (outer diameter) of the voice coil 14 is constructed smaller than the inner periphery shape (inner diameter) of the second magnetic pole 12. That is, the difference between the inner periphery shape (inner diameter) of the second magnetic pole 12 and the outer periphery shape (outer diameter) of the first magnetic pole 11 is constructed larger than the width of the voice coil 14 (that is, the difference between the outer diameter and the inner diameter of the voice coil 14). The outer periphery of the diaphragm 15 is fixed to the yoke 13. Then, the diaphragm 15 is arranged such as to be located in an open space formed between the first magnetic pole 11, the second magnetic pole 12, and the yoke 13. Further, the shape of the diaphragm 15 viewed from the vibrating directions is a circle. The above-mentioned shape and positional relation of the voice coil 14, the first magnetic pole 11, and the second magnetic pole 12 prevent the voice coil 14 from contacting with the first magnetic pole 11 or the second magnetic pole 12 even when the diaphragm 15 vibrates largely.

Here, as shown in FIG. 1, the voice coil 14 is adhered to the diaphragm 15 in such a manner that the center part of the diaphragm 15 has a convex shape relative to the outer periphery part. Specifically, the center part of the diaphragm 15 located inside the inner periphery shape of the voice coil 14 forms a convex shape. Further, the outer periphery part of the diaphragm 15 located outside the outer periphery shape of the voice coil 14 forms a concave shape. That is, in the diaphragm 15, a part opposing the first magnetic pole 11 is in a convex shape, while apart opposing the second magnetic pole 12 is in a concave shape. This shape of the diaphragm 15 realizes a shape that the diaphragm 15 hardly contacts with the first magnetic pole 11 and the second magnetic pole 12 at the time of vibration. Thus, even when the electrodynamic electroacoustic transducer is constructed into the same thickness as the conventional one, the magnets 11*a* and 12*a* can be made thicker with ensuring the same amplitude margin. Here, when such an effect is not desired, the diaphragm 15 need not have the centrally convex shape described above. The structure is such that the voice coil 14 does not contact with the first magnetic pole 11 or the second magnetic pole 12 as described above. Thus, even when this structure is employed solely, the magnets 11*a* and 12*a* can be made thicker with ensuring an amplitude margin. Further, the center part itself of the diaphragm 15 has a shape protruding toward the center axis as shown in FIG. 1. This improves the rigidity of the center part of the diaphragm 15, and hence provides an advantage in high-frequency range reproduction.

Further, in the outer periphery part of the diaphragm 15 located outside the outer periphery shape of the voice coil 14, an edge part 15*a* is formed as shown in FIG. 1. This edge part 15*a* allows the diaphragm 15 to vibrate in the up and down directions. The shape of the edge part 15*a* itself may be a plate shape, or alternatively may be a shape where the cross section has a rolled shape as shown in FIG. 1. When the shape of the edge part 15*a* itself is a shape where the cross section has a rolled shape, the restoring force against the amplitude of the diaphragm 15 becomes more linear. Thus, for example, an effect is obtained that distortion in the reproduced sound is reduced further so that the sound quality is improved. Here, as shown in FIG. 1, a part of the edge part 15*a* is formed such as to oppose at least the second magnetic pole part 12. Thus, the edge part 15*a* may be formed in the entire diaphragm 15 that opposes the second magnetic pole part 12. Further, the edge part 15*a* may be constructed integrally with the diaphragm 15 other than the edge part 15*a*, or alternatively may be constructed separately from the diaphragm 15 other than the edge part 15*a*.

Further, the magnet 11*a* and the magnet 12*a* are magnetized such as to be the same polarity (the polarities should be in the same direction) in the vibrating directions of the diaphragm 15. Further, in the yoke 13, a sound hole for emitting sound is formed on the front face side of the electrodynamic electroacoustic transducer 1, while sound holes for releasing pressure are formed on the rear face side. The operation of the electrodynamic electroacoustic transducer 1 is described below.

As described above, a magnetic gap is formed between the first magnetic pole 11 and the second magnetic pole 12. When a signal current flows through the voice coil 14 located in the magnetic gap, a driving force is generated that is proportional to the product between the magnitude of the current and the magnetic flux density at the voice coil position. Then, by virtue of the driving force, the diaphragm 15 vibrates and thereby emits sound. As such, the electroacoustic transducer according to the present embodiment is of electrodynamic type. That is, the electroacoustic transducer according to the present embodiment is a transducer in which an electric acoustic signal is applied directly to the voice coil 14, and hence is different from the electromagnetic induction type described above.

Here, the electrodynamic electroacoustic transducer according to a conventional art has been constructed such that a magnet and a yoke sandwich a diaphragm and a voice coil from the upper and lower directions. Thus, the voice coil need be prevented from contacting with the magnet and the yoke at the time of vibration of the diaphragm. This has limited the thickness of the magnet. However, the electrodynamic electroacoustic transducer 1 of the present embodiment is constructed such that the inner periphery of the voice coil 14 is larger than the outer periphery of the first magnetic pole 11 while the outer periphery of the voice coil 14 is smaller than the inner periphery of the second magnetic pole 12. Thus, even when the diaphragm 15 vibrates largely, the voice coil 14 does not contact with the first magnetic pole 11 or the second magnetic pole 12. Further, the diaphragm 15 and the magnetic poles (the first magnetic pole 11 and the second magnetic pole 12) are arranged in shapes and at positions that avoid contact with each other at the time of vibration. Thus, even when the electrodynamic electroacoustic transducer is constructed into the same thickness as the conventional one, the magnets 11*a* and 12*a* can be made thicker with ensuring the same amplitude margin. As a result, the magnetic flux density at the voice coil 14 position can be increased. Further, when the thicknesses of the magnets 11*a* and 12*a* are increased, the permeance coefficient increases even when high energy product magnets using neodymium or the like are employed. Thus, the magnets become more resistive against high temperature demagnetization than in the conventional art. That is, the temperature reliability of the electrodynamic electroacoustic transducer 1 is improved.

Here, the flow of magnetic flux constructed by the first magnetic pole 11 and the second magnetic pole 12 of the present embodiment is described below with reference to FIG. 3. Here, FIG. 3 is a diagram showing the flow of magnetic flux in a vector form, which is obtained in magnetic field analysis by a finite element method performed on an example of a magnetic circuit of the present embodiment. As seen from FIG. 3, the magnetic flux runs through the voice coil 14 so that a magnetic flux for driving is formed that has a directional component perpendicular to the vibrating directions. As such, the first magnetic pole 11 and the second magnetic pole 12 are in the positional relation of oblique direction relative to the vibrating directions of the diaphragm 15. Thus, the magnet 11*a* and the magnet 12*a* are magnetized into the same polarity in the vibrating directions, so that a magnetic flux for driving is formed that has a directional component perpendicular to the vibrating directions.

Figure 39:
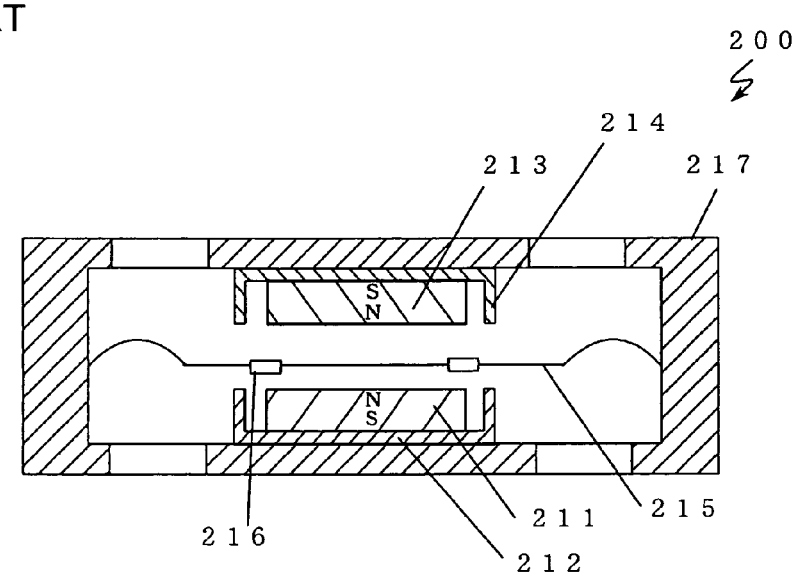
Fig. 39 PRIOR ART
FIG. 39 is a structure sectional view of an electrodynamic electroacoustic transducer 200 according to a conventional art.
Figure 40:
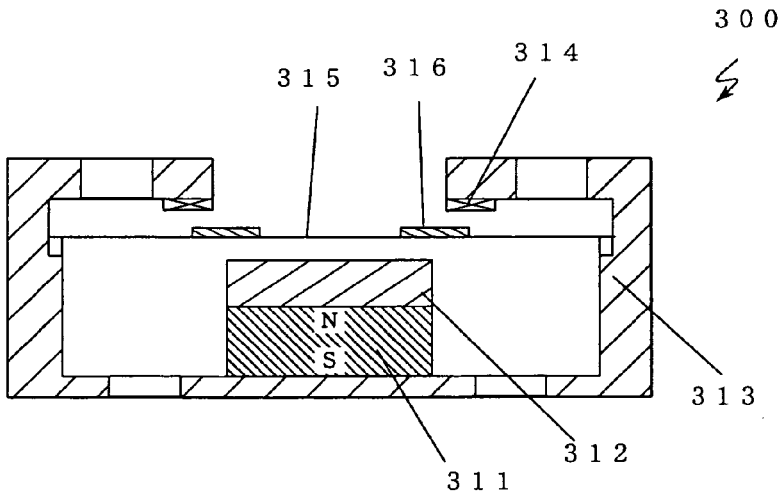
Fig. 40 PRIOR ART
FIG. 40 is a structure sectional view of an electromagnetic induction type electroacoustic transducer 300 according to a conventional art.

Further, FIG. 4 is a diagram in which the magnetic flux density at the voice coil position is compared between the two magnetic circuits consisting of the magnetic circuit of the conventional art example shown in FIG. 39 and the magnetic circuit of the present embodiment shown in FIG. 1, on condition that the thickness of the entire magnetic circuit and the material of the magnet are respectively the same. In FIG. 4, the horizontal axis indicates the amplitude of the diaphragm 15, while the vertical axis indicates the magnetic flux density at the voice coil position. As seen from the figure, when the magnetic circuit structure described in the present embodiment is employed, the magnetic flux density at the voice coil position is improved in comparison with the conventional art.

As described above, according to the electrodynamic electroacoustic transducer of the present embodiment, a higher performance electroacoustic transducer can be provided even for an electroacoustic transducer having the same thickness. Further, even in a case of the same performance, a smaller and thinner electroacoustic transducer can be provided. Further, since the magnetizing directions of the first magnetic pole 11 and the second magnetic pole 12 are the same, magnetization may be performed after the assembling of the electroacoustic transducer. As a result, an advantage is obtained in the number of fabrication process steps in comparison with the case that the two magnets are magnetized in the opposite directions.

Here, in the description given above, the shapes of the electrodynamic electroacoustic transducer 1, the first magnetic pole 11, the second magnetic pole 12, and the diaphragm 15 viewed from the vibrating directions have been assumed to be circles. Instead, the shapes may be ellipses.

Figure 5:
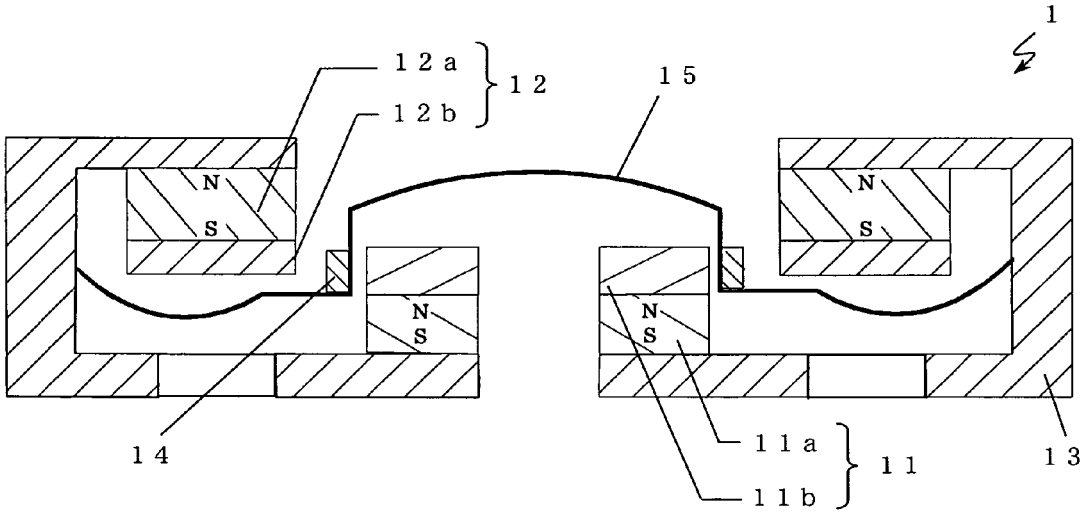
FIG. 5 is a structure sectional view where the shape of a first magnetic pole 11 is constructed from a circular columnar shape in which a coaxial through hole is formed, and where a lower face of a second magnetic pole 12 is arranged on a rear face side of an electrodynamic electroacoustic transducer 1 relative to an upper face of the first magnetic pole 11.

Further, in the electrodynamic electroacoustic transducer 1 described above, the first magnetic pole 11 has been assumed to be constructed in a circular columnar shape. Instead, the first magnetic pole 11 may be constructed from a cylindrical columnar body. In other words, the first magnetic pole 11 may be constructed from a columnar body having a through hole (hollow hole) formed coaxially to the circular columnar shape of the first magnetic pole 11 shown in FIG. 1. Further, in other words, the first magnetic pole 11 may be constructed from an annular body in which an open space is formed in the center. Further, the lower face of the second magnetic pole 12 may be arranged on a rear face side of an electrodynamic electroacoustic transducer 1 relative to the upper face of the first magnetic pole 11. FIG. 5 is a structure sectional view where the shape of a first magnetic pole 11 is constructed from a circular columnar shape in which a coaxial through hole is formed, and where a lower face of a second magnetic pole 12 is arranged on a rear face side of an electrodynamic electroacoustic transducer 1 relative to an upper face of the first magnetic pole 11. The second magnetic pole 12 is arranged such that a magnetic gap should be formed between the first magnetic pole 11 and the second magnetic pole 12. Further, at that time, in the yoke 13 as shown in FIG. 5, a sound hole is formed that has the same diameter as the above-mentioned through hole formed in the first magnetic pole part 11.

According to the structure shown in FIG. 5, the through hole formed coaxially to the first magnetic pole 11 allows air located between the upper face of the first magnetic pole 11 and the lower face of the diaphragm 15 to escape remarkably easily. That is, an effect is obtained that the sound from the lower face of the diaphragm 15 can escape downward easily. Further, the lower face of the second magnetic pole 12 is arranged on a rear face side of an electrodynamic electroacoustic transducer 1 relative to the upper face of the first magnetic pole 11. That is, in the structure shown in FIG. 5, when the thickness of the electrodynamic electroacoustic transducer itself is maintained the same, the magnet 11*a* and the magnet 12*a* can be made thicker in comparison with the structure shown in FIG. 1. Thus, this structure has an advantage from the perspective of high performance.

Figure 6:
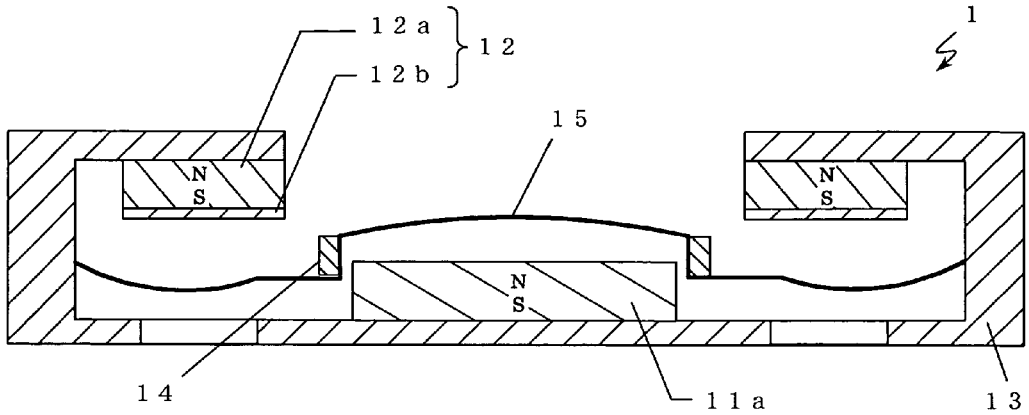
FIG. 6 is a structure sectional view where a plate 11*b* is omitted in an electrodynamic electroacoustic transducer 1 of FIG. 1.
Figure 7:
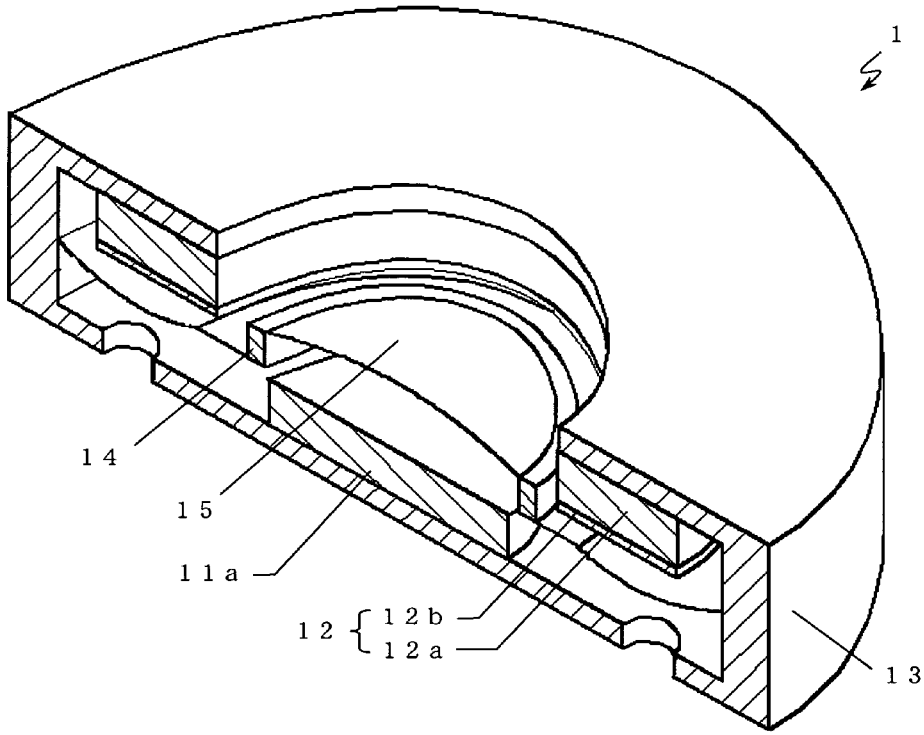
FIG. 7 is a perspective view where a part of an electrodynamic electroacoustic transducer 1 of FIG. 6 is cut off.

Further, in the electrodynamic electroacoustic transducer 1, the plate 11*b* of the first magnetic pole 11 may be omitted. FIG. 6 is a structure sectional view of the electrodynamic electroacoustic transducer 1 described above, where the plate 11*b* is omitted. FIG. 7 is a perspective view of the electrodynamic electroacoustic transducer 1 where the plate 11*b* is omitted while a part is cut of f. In the electrodynamic electroacoustic transducer 1 shown in FIGS. 6 and 7, the plate 11*b* is omitted. Thus, the operating point of the magnet 11*a* goes down. However, in the fabrication, an advantage is obtained from the perspective of materials and the number of process steps. Further, in FIGS. 6 and 7, the first magnetic pole 11 is constructed from the magnet 11*a*. Instead, the first magnetic pole 11 may be constructed from a magnetic material such as iron other than a magnet.

Figure 8:
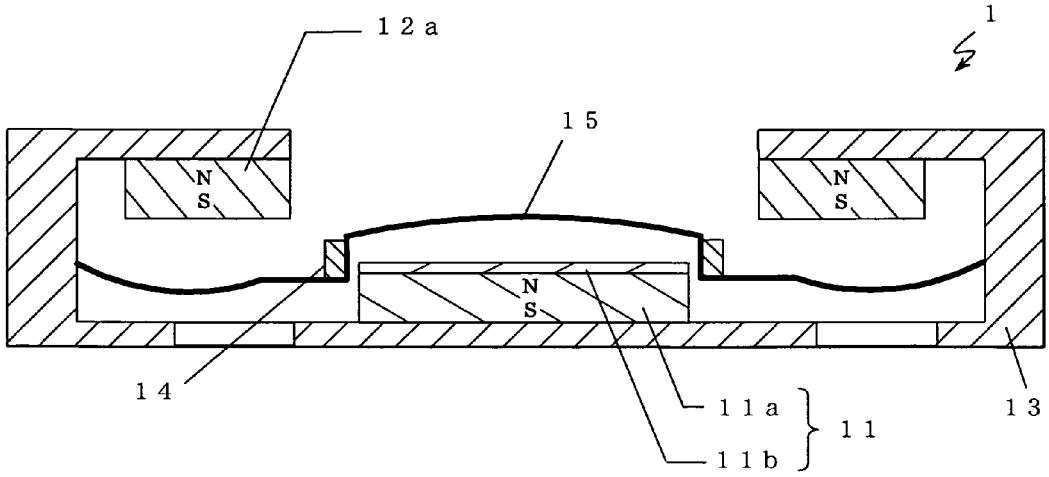
FIG. 8 is a structure sectional view where a plate 12*b* is omitted in an electrodynamic electroacoustic transducer 1 of FIG. 1.
Figure 9:
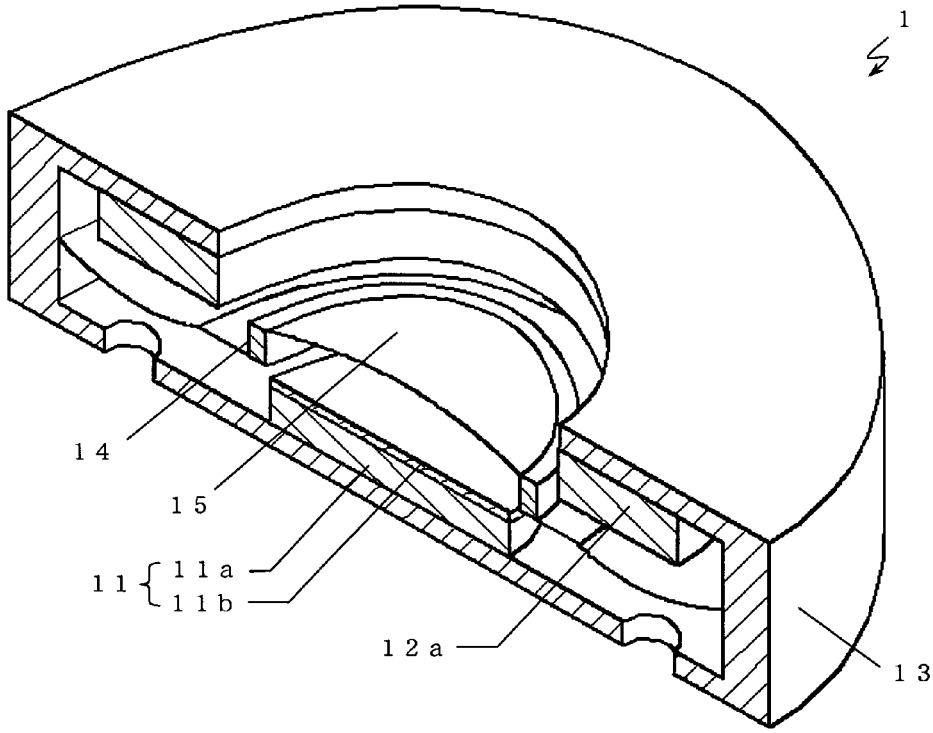
FIG. 9 is a perspective view where a part of an electrodynamic electroacoustic transducer 1 of FIG. 8 is cut off.

Further, in the electrodynamic electroacoustic transducer 1, the plate 12*b* of the second magnetic pole 12 may be omitted. FIG. 8 is a structure sectional view of the electrodynamic electroacoustic transducer 1 described above, where the plate 12*b* is omitted. FIG. 9 is a perspective view of the electrodynamic electroacoustic transducer 1 where the plate 12*b* is omitted while a part is cut off. In the electrodynamic electroacoustic transducer 1 shown in FIGS. 8 and 9, the plate 12*b* is omitted. Thus, the operating point of the magnet 12*a* goes down. However, in the fabrication, an advantage is obtained from the perspective of materials and the number of process steps. Further, in FIGS. 8 and 9, the second magnetic pole 12 is constructed from the magnet 12*a*. Instead, the second magnetic pole 12 may be constructed from a magnetic material such as iron other than a magnet.

Figure 10:
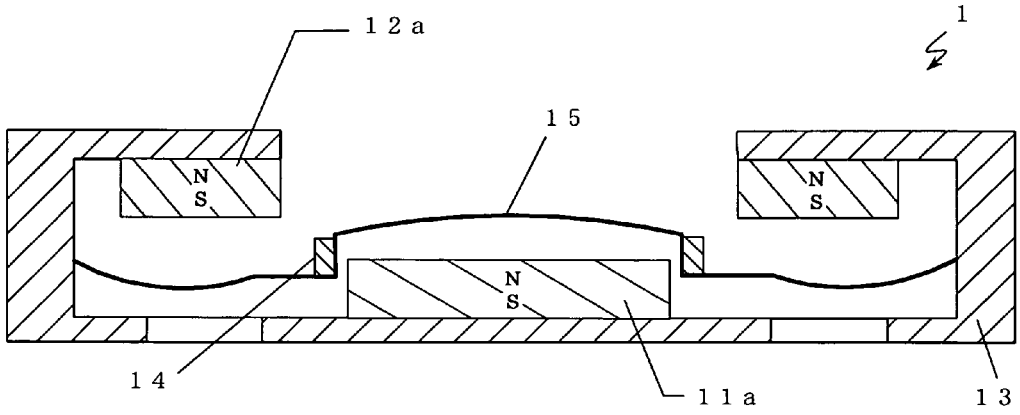
FIG. 10 is a structure sectional view where a plate 11*b* and a plate 12*b* are omitted in an electrodynamic electroacoustic transducer 1 of FIG. 1.
Figure 11:
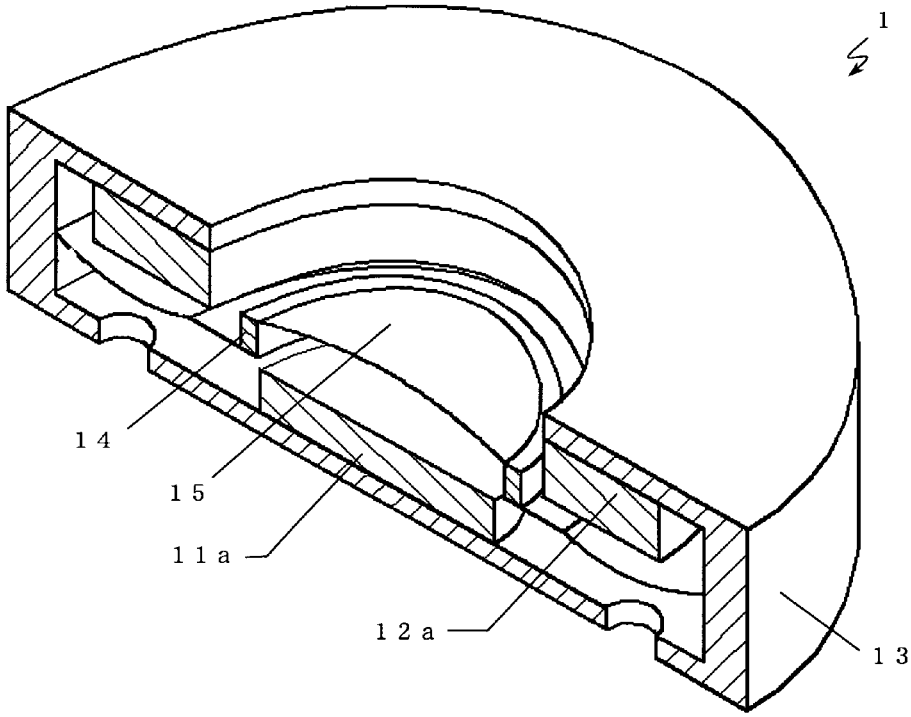
FIG. 11 is a perspective view where a part of an electrodynamic electroacoustic transducer 1 of FIG. 10 is cut off.

Further, in the electrodynamic electroacoustic transducer 1, both of the plate 11*b* of the first magnetic pole 11 and the plate 12*b* of the second magnetic pole 12 may be omitted. FIG. 10 is a structure sectional view where the plate 11*b* and the plate 12*b* are omitted in the electrodynamic electroacoustic transducer 1 described above. FIG. 11 is a perspective view of the electrodynamic electroacoustic transducer 1 where the plate 11*b* and the plate 12*b* are omitted while a part is cut off. In the electrodynamic electroacoustic transducer 1 shown in FIGS. 10 and 11, the plate 11*b* and the plate 12*b* are omitted. Thus, the operating points of the magnet 11*a* and the magnet 12*a* go down. However, in the fabrication, an advantage is obtained from the perspective of materials and the number of process steps. Further, in FIGS. 10 and 11, the first magnetic pole 11 is constructed from the magnet 11*a*, while the second magnetic pole 12 is constructed from the magnet 12*a*. Instead, the magnet of anyone of the magnetic poles may be constructed from a magnetic material such as iron other than a magnet.

As such, according to the electrodynamic electroacoustic transducer of the first embodiment, the structure is such that the inner periphery shape of the second magnetic pole 12 is larger than the outer periphery shape of the first magnetic pole 11, and that the second magnetic pole 12 is located in an oblique front face direction expanding from the first magnetic pole 11, so that the first and the second magnetic poles do not overlap with each other in the vibrating directions of the diaphragm. Then, when a shape is constructed such that the diaphragm should be separated from the first and the second magnetic poles by an amplitude margin, the thickness of the magnet in the vibrating directions can be made thicker in comparison with the conventional art when an electrodynamic electroacoustic transducer is to be implemented that has the same thickness. This improves the magnetic flux density at the voice coil position, and hence realizes an electrodynamic electroacoustic transducer of high performance that has the same thickness as the conventional one.

Further, according to the electrodynamic electroacoustic transducer of the first embodiment, the structure is such that the inner periphery shape of the voice coil is larger than the outer periphery shape of the first magnetic pole, while the outer periphery shape of the voice coil is smaller than the inner periphery shape of the second magnetic pole. Thus, the first and the second magnetic poles are not present in the vibrating directions of the voice coil. Accordingly, when a shape is constructed such that the diaphragm should be separated from the first and the second magnetic poles by an amplitude margin, the thicknesses of the magnets in the vibrating directions can still be made thicker. That is, in the conventional art, the configuration that the magnets, the yoke, and the voice coil overlap with each other in the diaphragm vibrating directions has limited the magnet thickness. In contrast, the structure is adopted that the voice coil and the magnets should not overlap in the thickness directions, while the shape is adopted that the diaphragm should not easily contact with the first and the second magnetic poles at the time of diaphragm vibration. As a result, the magnets can still be made thicker. This improves further the magnetic flux density at the voice coil position, and hence realizes a high performance electroacoustic transducer even having a reduced thickness. Here, when this effect obtained by the shape of the voice coil is not desired, the structure may be such that the inner periphery shape of the voice coil is smaller than the outer periphery shape of the first magnetic pole and/or the outer periphery shape of the voice coil is larger than the inner periphery shape of the second magnetic pole.

Further, when a magnet is made thicker, in a magnet fabricated from neodymium used generally in a small and thin speaker, the permeance coefficient increases so that the magnet becomes resistive against high temperature demagnetization. Thus, with increasing the temperature reliability or alternatively maintaining the same temperature reliability, a magnet having a higher energy product can be employed. This improves further the magnetic flux density at the voice coil position, and hence realizes a small and thin electroacoustic transducer of higher performance.

Further, the first magnetic pole and the second magnetic pole have the same polarity. Thus, even when both of the first magnetic pole and the second magnetic pole are constructed from a magnetic material including a magnet, magnetization can be performed after the assembling of the electroacoustic transducer. This provides an advantage in the fabrication in comparison with the case that the two magnets are magnetized in the opposite directions.

Further, the electrodynamic electroacoustic transducer according to the first embodiment is not of electromagnetic induction type that employs a driving primary coil 314 causing a reduction in the magnetic flux density in the magnetic gap. Thus, when the same thickness as the electromagnetic induction type is adopted, the magnetic flux density in the magnetic gap can be improved in comparison with the electromagnetic induction type.

Second Embodiment

Figure 12:
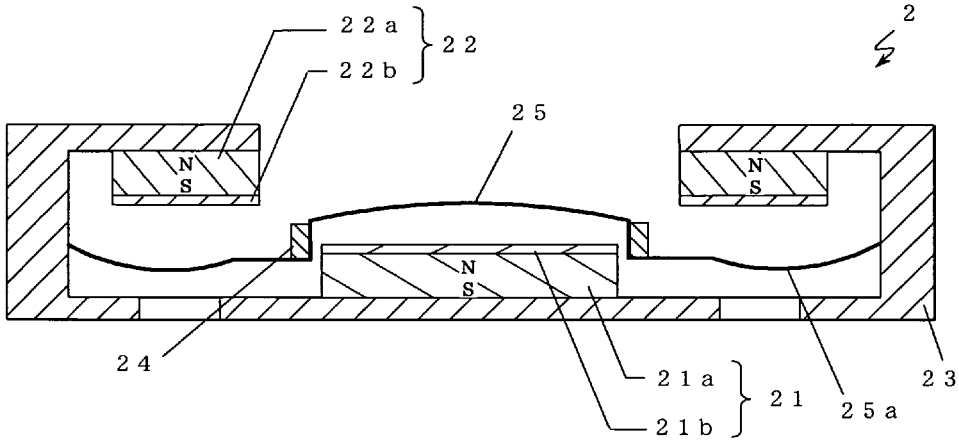
FIG. 12 is a structure sectional view of an electrodynamic electroacoustic transducer 2 according to a second embodiment.
Figure 13:
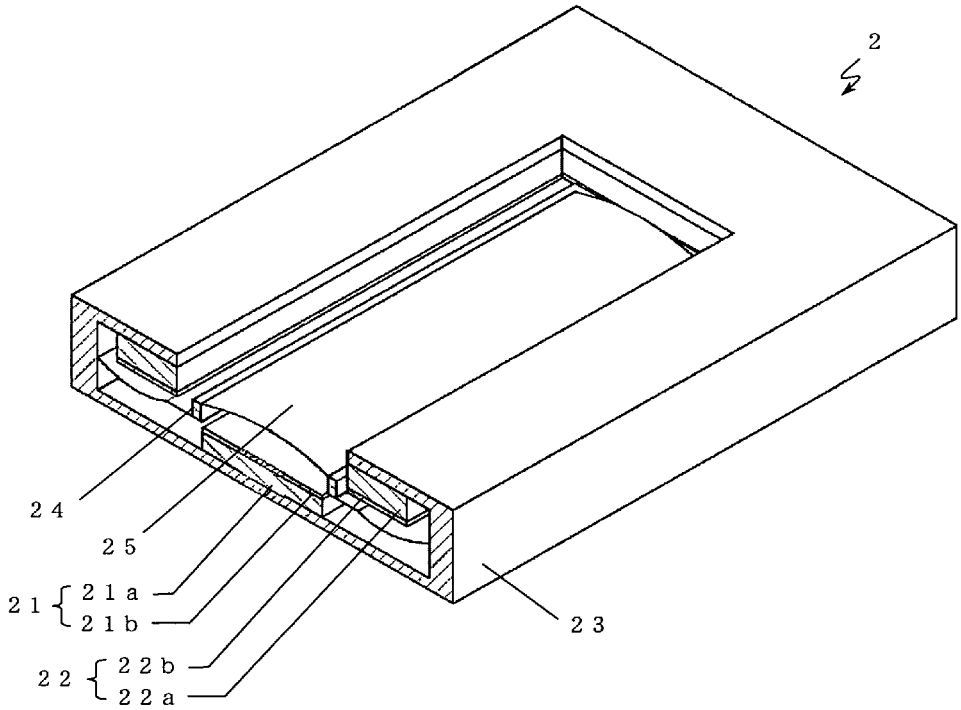
FIG. 13 is a perspective view where a part of an electrodynamic electroacoustic transducer 2 of FIG. 12 is cut off.

An electrodynamic electroacoustic transducer 2 according to a second embodiment of the present invention is described below with reference to FIGS. 12 and 13. Here, FIG. 12 is a structure sectional view of an electrodynamic electroacoustic transducer 2 according to the second embodiment. FIG. 13 is a perspective view where a part of the electrodynamic electroacoustic transducer 2 is cut off. In FIG. 12, the electrodynamic electroacoustic transducer 2 comprises a first magnetic pole 21, a second magnetic pole 22, a yoke 23, a voice coil 24, and a diaphragm 25. Here, as shown in FIG. 13, the shape of the electrodynamic electroacoustic transducer 2 viewed from the vibrating directions is a rectangle. Further, the first magnetic pole 21 corresponds to the first magnetic pole part of the present invention, while the second magnetic pole 22 corresponds to the second magnetic pole part of the present invention.

The first magnetic pole 21 is constructed from a magnet 21*a* and a plate 21*b* adhered to the upper face of the magnet 21*a*. The second magnetic pole 22 is constructed from a magnet 22*a* and a plate 22*b* adhered to the lower face of the magnet 22*a*. The plates 21*b* and 22*b* are composed of magnetic materials (such as iron) other than a magnet. Here, as shown in FIG. 13, the shape of the first magnetic pole 21 is constructed in a rectangular parallelepiped (columnar body), while the shape of the second magnetic pole 22 is constructed from an annular body where a rectangular opening is formed in the center part of a rectangular parallelepiped.

Here, the second magnetic pole 22 is located on the front face side of the electrodynamic electroacoustic transducer 2 relative to the first magnetic pole 21. Further, the first magnetic pole 21 and the second magnetic pole 22 are arranged such that the center axes should agree with each other. Further, the inner periphery shape (the inner side length of the opening) of the second magnetic pole 22 is larger than the outer periphery shape (the outer side length excluding the sides parallel to the above-mentioned center axis) of the first magnetic pole 21. Then, the lower face of the second magnetic pole 22 is arranged at the same position as the upper face of the first magnetic pole 21 or alternatively at least on the front face side of the electrodynamic electroacoustic transducer 2 relative to the upper face. That is, the second magnetic pole 22 is located in an oblique front face direction expanding from the first magnetic pole 21, and is arranged such that a magnetic gap should be formed between the first magnetic pole 21 and the second magnetic pole 22. Here, the magnetic gap between the first magnetic pole 21 and the second magnetic pole 22 is formed, for example, in a uniform dimension along the circumference.

The yoke 23 fixes the lower face of the first magnetic pole 21 and the upper face of the second magnetic pole 22, and magnetically couples the first magnetic pole 21 with the second magnetic pole 22 so as to support them. Here, each of the lower face of the first magnetic pole 21 and the upper face of the second magnetic pole 22 corresponds to one magnetic pole face of the present invention. The voice coil 24 has a rectangular frame shape and is adhered to the diaphragm 25 so as to be retained in the above-mentioned magnetic gap by the diaphragm 25. Further, the inner periphery shape (the inner sides) of the voice coil 24 is constructed larger than the outer periphery shape (the outer sides opposing the inner sides of the voice coil 24) of the first magnetic pole 21. The outer periphery shape (the outer sides) of the voice coil 24 is constructed smaller than the inner periphery shape (the inner sides opposing the outer sides of the voice coil 24) of the second magnetic pole 22. That is, the difference between the inner periphery shape (the inner sides) of the second magnetic pole 22 and the outer periphery shape (the outer sides opposing the inner sides of the second magnetic pole 22) of the first magnetic pole 21 is constructed larger than the frame width of the voice coil 24. The outer periphery of the diaphragm 25 is fixed to the yoke 23. Then, the diaphragm 25 is arranged such as to be located in an open space formed between the first magnetic pole 21, the second magnetic pole 22, and the yoke 23. Further, the shape of the diaphragm 25 viewed from the vibrating directions is a rectangle. Further, in the diaphragm 25, an edge part 25*a* is formed that is similar to the edge part 15*a* of the diaphragm 15 described above.

Here, the magnet 21*a* and the magnet 22*a* are magnetized into the same polarity in the vibrating directions of the diaphragm 25. Further, in the yoke 23, a sound hole for emitting sound is formed on the front face side of the electrodynamic electroacoustic transducer 2, while sound holes for releasing pressure are formed on the rear face side.

Here, the electrodynamic electroacoustic transducer 2 according to the second embodiment is different from the electrodynamic electroacoustic transducer 1 described in the first embodiment, only with respect to the shape. Thus, the operation of the electrodynamic electroacoustic transducer 2 is similar to the operation of the electrodynamic electroacoustic transducer 1, and hence detailed description is omitted. Further, in the electrodynamic electroacoustic transducer 2 according to the second embodiment, an effect similar to that of the first embodiment is obtained.

Here, the outer shape of the electrodynamic electroacoustic transducer 2 viewed from the vibrating directions and the shapes of the first magnetic pole 21, the second magnetic pole 22, and the diaphragm 25 are rectangles. In general, a large number of rectangular spaces are present inside the housing of an electronic device. Thus, since the shape of the electrodynamic electroacoustic transducer 2 viewed from the vibrating directions is a rectangle, the transducer can be installed in a space inside the electronic device without uselessness. That is, in the electrodynamic electroacoustic transducer 2, an improved space utilization factor is achieved in the same space in comparison with the electrodynamic electroacoustic transducer 1 of a circular shape. Further, since the shape of the diaphragm 25 is also a rectangle, a larger area of the diaphragm is ensured in the same space. That is, the performance is improved by the amount of increase in the ensured larger area of the diaphragm 25 of the electrodynamic electroacoustic transducer 2.

Here, similarly to the first embodiment, at least one of the plates 21*b* and 22*b* of the electrodynamic electroacoustic transducer 2 may be omitted. Further, although the first magnetic pole 21 includes the magnet 21*a* while the second magnetic pole 22 includes the magnet 22*a*, the magnet of any one of the magnetic poles may be constructed from a magnetic material such as iron other than a magnet.

Further, although the outer shape of the electrodynamic electroacoustic transducer 2 viewed from the vibrating directions and the shapes of the first magnetic pole 21, the second magnetic pole 22, and the diaphragm 25 have been rectangles, other polygonal shapes may be employed. Further, shapes in accordance with the inside shape or the application of the electronic components housing may be employed. For example, an elongate quadrangle shape may be employed where two opposing parallel sides are extremely shorter than the other two sides. Further, for example, a shape may be employed where corners or the entirety or a part of sides of a polygonal shape have a roundness.

Figure 14:
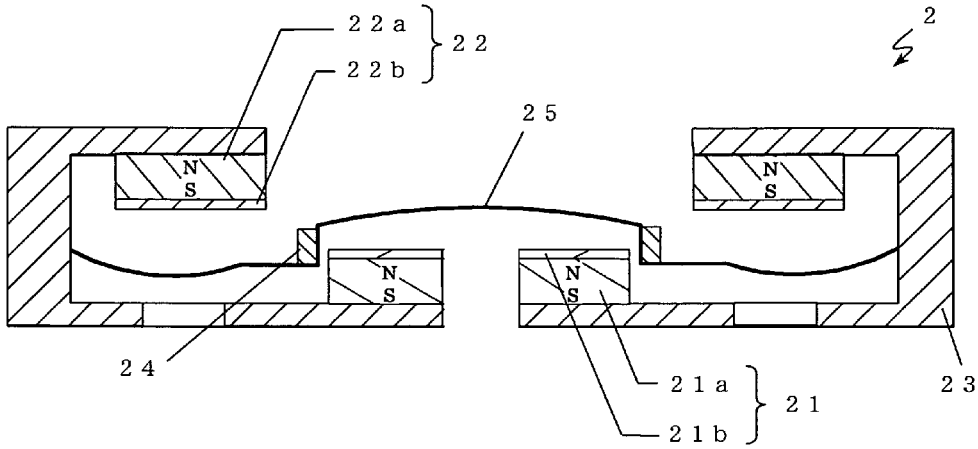
FIG. 14 is a structure sectional view of an electrodynamic electroacoustic transducer 2, showing a configuration that the shape of a first magnetic pole 21 is a frame shape.
Figure 15:
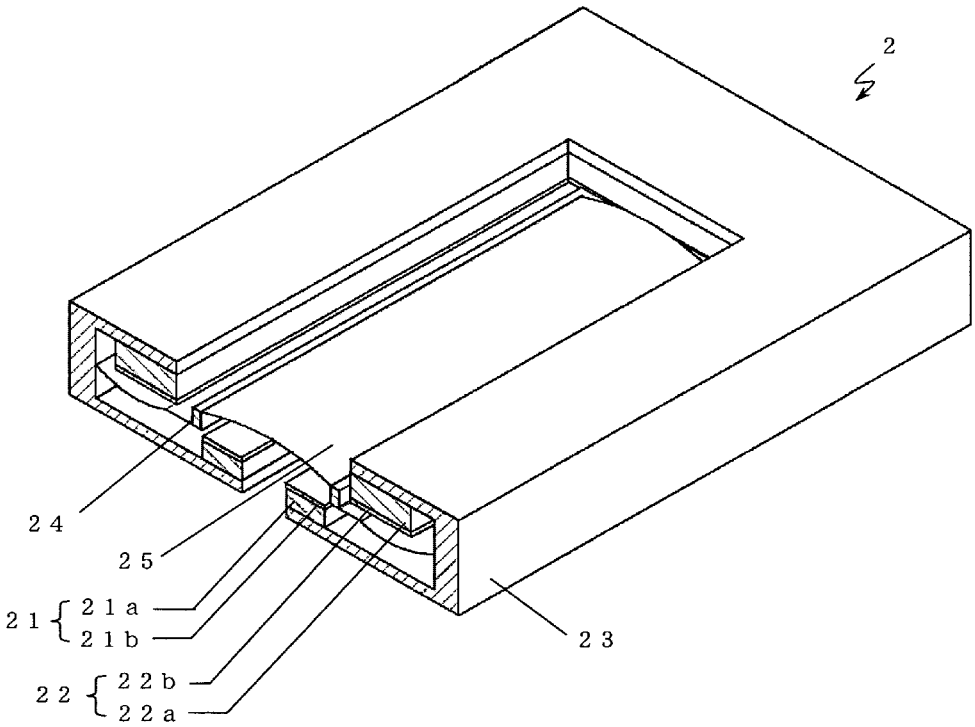
FIG. 15 is a perspective view where a part of an electrodynamic electroacoustic transducer 2 of FIG. 14 is cut off.

Further, in the electrodynamic electroacoustic transducer 2 described above, the first magnetic pole 21 has been assumed to be constructed in a rectangular parallelepiped. However, as shown in FIGS. 14 and 15, a rectangular frame shape may be employed. In other words, the first magnetic pole 21 may be constructed from a columnar body having a rectangular through hole (hollow hole) formed coaxially to the rectangular parallelepiped of the first magnetic pole 21 shown in FIGS. 12 and 13. Further, in other words, the first magnetic pole 21 may be constructed from an annular body in which a rectangular open space is formed. FIG. 14 is a structure sectional view of an electrodynamic electroacoustic transducer 2, showing a configuration that the shape of the first magnetic pole 21 is a frame shape. FIG. 15 is a perspective view where a part of the electrodynamic electroacoustic transducer 2 is cut off, showing a configuration that the shape of the first magnetic pole 21 is a frame shape. The second magnetic pole 22 is arranged such that a magnetic gap should be formed between the first magnetic pole 21 and the second magnetic pole 22. Further, at that time, in the yoke 23 as shown in FIG. 14, a sound hole is formed that has the same diameter as the above-mentioned through hole formed in the first magnetic pole part 21. According to the structure shown in FIGS. 14 and 15, the through hole formed coaxially to the first magnetic pole 21 allows air located between the upper face of the first magnetic pole 21 and the lower face of the diaphragm 25 to escape remarkably easily. That is, the structure shown in FIGS. 14 and 15 provides an effect that the sound from the lower face of the diaphragm 15 can escape downward easily.

Third Embodiment

Figure 16:
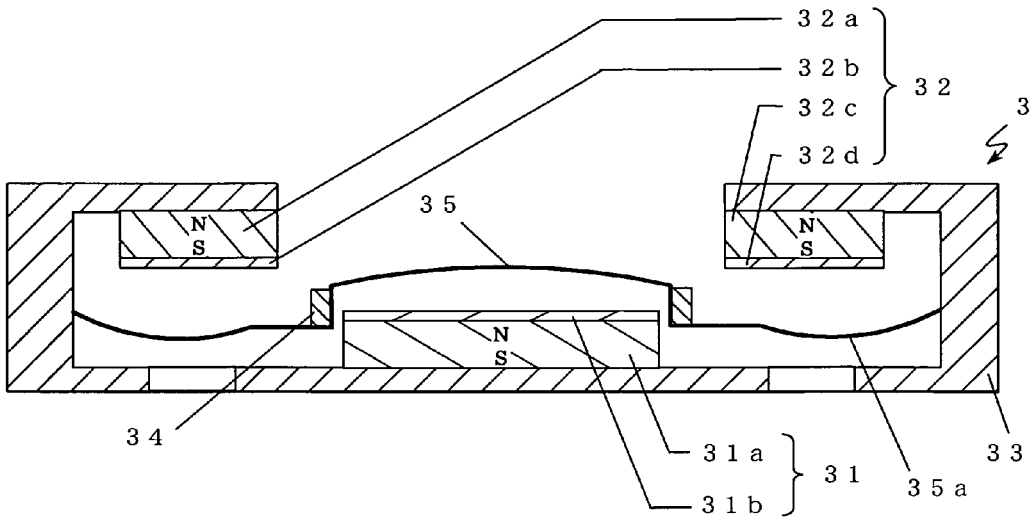
FIG. 16 is a structure sectional view of an electrodynamic electroacoustic transducer 3 according to a third embodiment.
Figure 17:
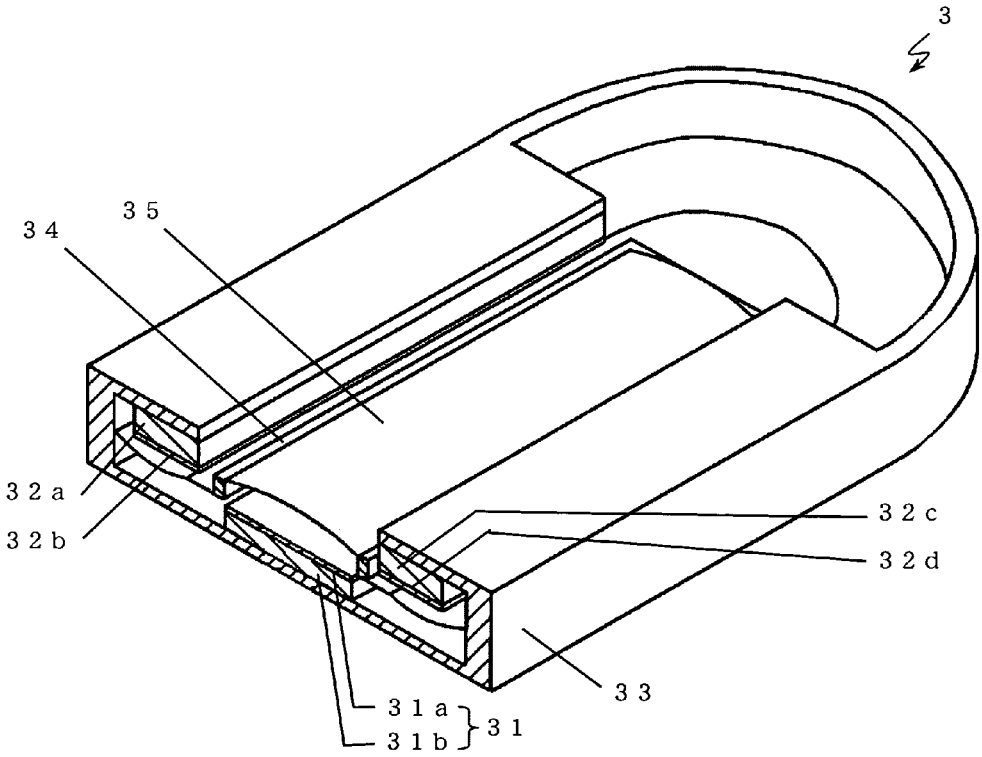
FIG. 17 is a perspective view where a part of an electrodynamic electroacoustic transducer 3 of FIG. 16 is cut off.

An electrodynamic electroacoustic transducer 3 according to a third embodiment of the present invention is described below with reference to FIGS. 16 and 17. Here, FIG. 16 is a structure sectional view of an electrodynamic electroacoustic transducer 3 according to the third embodiment. FIG. 17 is a perspective view where a part of the electrodynamic electroacoustic transducer 3 is cut off. In FIG. 16, the electrodynamic electroacoustic transducer 3 comprises a first magnetic pole 31, a second magnetic pole 32, a yoke 33, a voice coil 34, and a diaphragm 35. Here, as shown in FIG. 17, the shape of the electrodynamic electroacoustic transducer 3 viewed from the vibrating directions is a shape like a racing track (referred to as a track shape, hereinafter) in which only the two opposing sides of the rectangle are formed by semicircles. Further, the first magnetic pole 31 corresponds to the first magnetic pole part of the present invention, while the second magnetic pole 32 corresponds to the second magnetic pole part of the present invention.

The first magnetic pole 31 is constructed from a magnet 31*a* and a plate 31*b* adhered to the upper face of the magnet 31*a*. The second magnetic pole 32 is constructed from: a magnet 32*a* and a plate 32*b* adhered to the lower face of the magnet 32*a*; and a magnet 32*c* and a plate 32*d* adhered to the lower face of the magnet 32*c*. The plates 31*b*, 32*b*, and 32*d* are composed of magnetic materials (such as iron) other than a magnet. Here, as shown in FIG. 17, the shape of the first magnetic pole 31 is a rectangular parallelepiped (columnar body). Further, the shape of the second magnetic pole 32 is constructed from two rectangular parallelepipeds (the magnet 32*a* plus the plate 32*b* and the magnet 32*c* plus the plate 32*d*) in which a curved frame part is removed from an annular body where a rectangular opening is formed in the center part of a track-shaped columnar body.

Here, the second magnetic pole 32 is located on the front face side of the electrodynamic electroacoustic transducer 3 relative to the first magnetic pole 31. Further, each of the two rectangular parallelepipeds that constitute the second magnetic pole 32 is arranged at a position opposing each longer side of the first magnetic pole 31. In other words, the annular body of a track shape that constitutes the second magnetic pole 32 and the first magnetic pole 31 are arranged such that the center axes should agree with each other. Further, the inner periphery shape (the shorter inner sides of the opening) of the annular body of the second magnetic pole 32 is larger than the outer periphery shape (the shorter outer sides opposing the shorter inner sides of the second magnetic pole 32) of the first magnetic pole 31. Then, the lower face of the second magnetic pole 32 is arranged at the same position as the upper face of the first magnetic pole 31 or alternatively at least on the front face side of the electrodynamic electroacoustic transducer 3 relative to the upper face. That is, the two rectangular parallelepipeds that constitute the second magnetic pole 32 are located respectively in an oblique front face direction expanding from the first magnetic pole 31, and arranged such that a magnetic gap is formed between the two rectangular parallelepipeds that constitute the second magnetic pole 32 and the first magnetic pole 31. Here, the magnetic gap between the first magnetic pole 31 and the second magnetic pole 32 may be formed, for example, such as to have a uniform dimension across the space where they oppose each other.

The yoke 33 fixes the lower face of the first magnetic pole 31 and the upper face of the second magnetic pole 32, and magnetically couples the first magnetic pole 31 with the second magnetic pole 32 so as to support them. Here, each of the lower face of the first magnetic pole 31 and the upper face of the second magnetic pole 32 corresponds to one magnetic pole face of the present invention. The voice coil 34 has a rectangular frame shape and is adhered to the diaphragm 35 so that two sides are retained in the above-mentioned magnetic gap. Further, the inner periphery shape (the inner sides) of the voice coil 34 is constructed larger than the outer periphery shape (the outer sides opposing the inner sides of the voice coil 34) of the first magnetic pole 31. The outer periphery shape of the voice coil 34 (the two shorter outer sides among the outer sides) is constructed smaller than the inner periphery shape (the shorter inner sides opposing the shorter outer sides of the voice coil 34) of the annular body of the second magnetic pole 32. That is, the difference between the inner periphery shape (the shorter inner sides) of the second magnetic pole 32 and the outer periphery shape (the shorter outer sides opposing the shorter inner sides of the second magnetic pole 32) of the first magnetic pole 31 is constructed larger than the frame width of the voice coil 34. That is, according to the structure of the present embodiment, as shown in FIG. 16, the voice coil 34 does not contact with the first magnetic pole 31 and the second magnetic pole 32 in the vibrating directions. The outer periphery of the diaphragm 35 is fixed to the yoke 33. Then, the diaphragm 35 is arranged such as to be located in an open space formed between the first magnetic pole 31, the second magnetic pole 32, and the yoke 33. Further, the shape of the diaphragm 35 viewed from the vibrating directions is a track shape. Further, in the diaphragm 35, an edge part 35*a* is formed that is similar to the edge part 15*a* of the diaphragm 15 described above.

Here, the magnet 31*a*, the magnet 32*a*, and the magnet 32*c* are magnetized into the same polarity in the vibrating directions of the diaphragm 35. Further, in the yoke 33, a sound hole for emitting sound is formed on the front face side of the electrodynamic electroacoustic transducer 3, while sound holes for releasing pressure are formed on the rear face side.

Here, the electrodynamic electroacoustic transducer 3 according to the third embodiment is different from the electrodynamic electroacoustic transducer 1 described in the first embodiment, only with respect to the shape. Thus, the operation of the electrodynamic electroacoustic transducer 3 is similar to the operation of the electrodynamic electroacoustic transducer 1, and hence detailed description is omitted. Further, in the electrodynamic electroacoustic transducer 3 according to the third embodiment, an effect similar to that of the first embodiment is obtained.

Here, the outer shape of the electrodynamic electroacoustic transducer 3 according to the present embodiment and the shape of the diaphragm 35 viewed from the vibrating directions are track shapes. That is, since the electrodynamic electroacoustic transducer 3 and the diaphragm 35 are not of a circular shape, space utilization efficiency is improved similarly to the second embodiment. Further, in contrast to the second embodiment where the rectangular shape has caused an increase in the edge stiffness in the corner part, the structure according to the third embodiment employs curves so that the entire stiffness is maintained in a good balance. Thus, according to the third embodiment, easy vibration is allowed in the corner part in comparison with the rectangular diaphragm, so that an electroacoustic transducer is realized in which distortion is reduced in a low pitch sound range.

Here, similarly to the first embodiment, at least one of the plate 31*b*, the plate 32*b*, and the plate 32*d* of the electrodynamic electroacoustic transducer 3 may be omitted. Further, although the first magnetic pole 31 includes the magnet 31*a* while the second magnetic pole 32 includes the magnets 32*a* and 32*c*, the magnet of any one of the magnetic poles may be constructed from a magnetic material such as iron other than a magnet.

Figure 18:
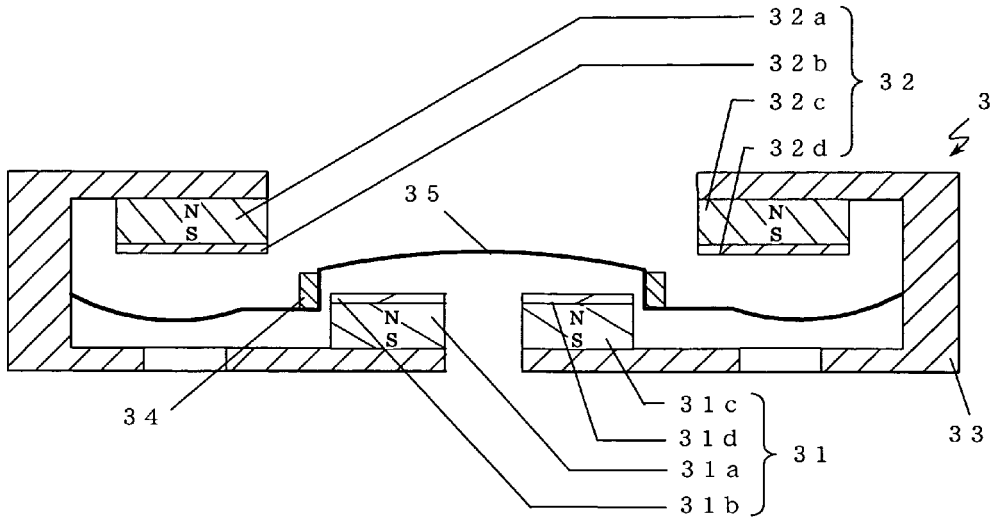
FIG. 18 is a structure sectional view of an electrodynamic electroacoustic transducer 3 in a case that a first magnetic pole 31 is constructed from two rectangular parallelepipeds.
Figure 19:
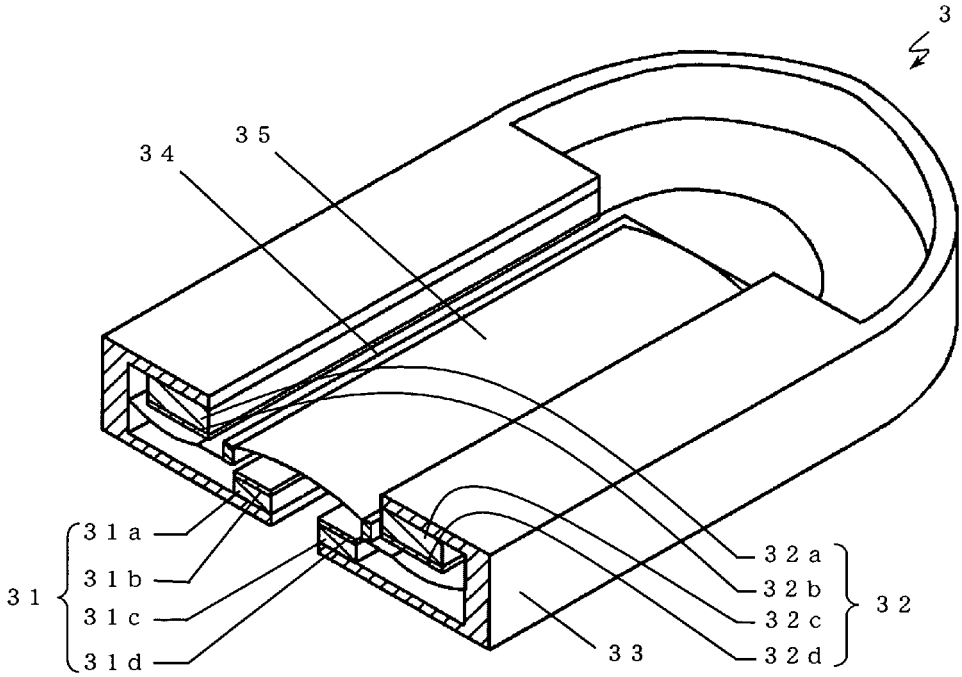
FIG. 19 is a perspective view where a part of an electrodynamic electroacoustic transducer 3 of FIG. 18 is cut off.

Further, the first magnetic pole 31 described above has been assumed to be constructed from a single rectangular parallelepiped. Instead, as shown in FIGS. 18 and 19, the first magnetic pole 31 may be constructed from two rectangular parallelepipeds (the magnet 31*a* plus the plate 31*b* and the magnet 31*c* plus the plate 31*d*) such that a space should be provided in the center part. In other words, in the first magnetic pole 31 formed by a columnar body shown in FIGS. 16 and 17, a through hole may be formed that has a center line on a straight line which is in the same direction as the longer sides in the direction perpendicular to the vibrating directions and which has an intersection on the center axis of the vibrating directions. FIG. 18 is a structure sectional view of an electrodynamic electroacoustic transducer 3 in a case that the first magnetic pole 31 is constructed from two rectangular parallelepipeds (two columnar bodies). FIG. 19 is a perspective view where a part of the electrodynamic electroacoustic transducer 3 is cut off, in a case that the first magnetic pole 31 is constructed from two rectangular parallelepipeds (two columnar bodies). At that time, as shown in FIG. 18, in the yoke 33, a sound hole is formed that has the same outer diameter as the through hole formed between the two rectangular parallelepipeds in the first magnetic pole part 31 described above. When the first magnetic pole 31 is constructed from the two rectangular parallelepipeds, the structure becomes such that air located between the upper face of the first magnetic pole 31 and the lower face of the diaphragm 35 can escape remarkably easily. That is, an effect is obtained that the sound from the lower face of the diaphragm 35 can escape downward easily.

Fourth Embodiment

Figure 20:
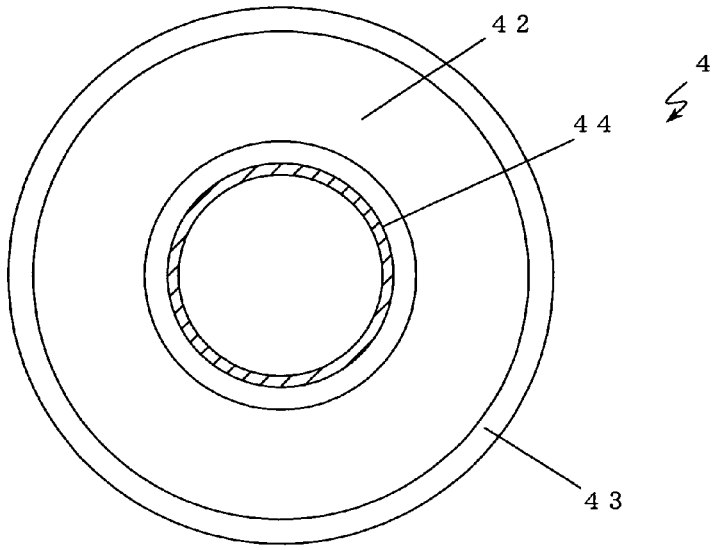
FIG. 20 is a plan view of an electrodynamic electroacoustic transducer 4 according to a fourth embodiment.
Figure 21:
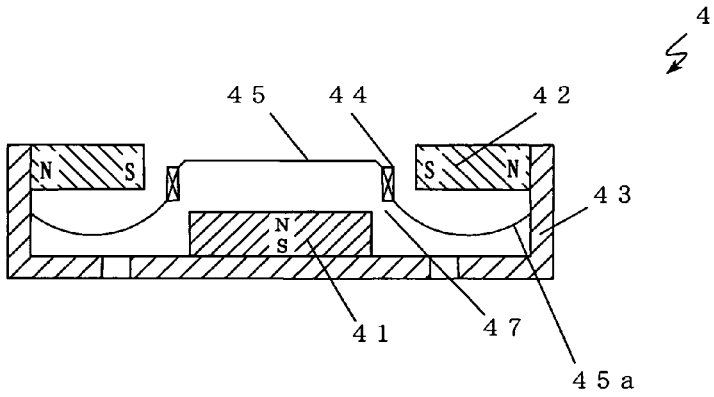
FIG. 21 is a structure sectional view of an electrodynamic electroacoustic transducer 4 according to a fourth embodiment.

An electrodynamic electroacoustic transducer 4 according to a fourth embodiment of the present invention is described below with reference to FIGS. 20 and 21. Here, FIG. 20 is a plan view of an electrodynamic electroacoustic transducer 4 according to the fourth embodiment. FIG. 21 is a structure sectional view of the electrodynamic electroacoustic transducer 4 according to the fourth embodiment. In FIG. 20, the shape of the electrodynamic electroacoustic transducer 4 is a circle. In FIG. 21, the electrodynamic electroacoustic transducer 4 comprises a first magnet 41, a second magnet 42, a yoke 43, a voice coil 44, and a diaphragm 45. Further, the first magnet 41 and the second magnet 42 construct a magnetic gap 47. The first magnet 41 has a circular columnar shape. The second magnet 42 is an annular body of a doughnut shape. Further, the first magnet 41 corresponds to the first magnetic pole part of the present invention, while the second magnet 42 corresponds to the second magnetic pole part of the present invention.

Here, the second magnet 42 is located on the front face side of the electrodynamic electroacoustic transducer 4 relative to the first magnet 41. Further, the first magnet 41 and the second magnet 42 are arranged such that the center axes should agree with each other. Further, the inner diameter of the second magnet 42 is larger than the outer diameter of the first magnet 41. The yoke 43 fixes respectively the lower face of the first magnet 41 and the magnetic pole face on the outer periphery side of the second magnet 42, and magnetically couples the first magnet 41 and the second magnet 42 so as to support them. The voice coil 44 has a ring shape as shown in FIG. 19, and is adhered to the diaphragm 45 so as to be retained in the magnetic gap 47 by the diaphragm 45. Further, the inner diameter of the voice coil 44 is constructed larger than the outer diameter of the first magnet 41. The outer diameter of the voice coil 44 is constructed smaller than the inner diameter of the second magnet 42. The outer periphery of the diaphragm 45 is fixed to the yoke 43. Then, the diaphragm 45 is arranged such as to be located in an open space formed between the first magnet 41, the second magnet 42, and the yoke 43. Further, the shape of the diaphragm 45 viewed from the vibrating directions is a circle. Further, in the diaphragm 45, an edge part 45*a* is formed that is similar to the edge part 15*a* of the diaphragm 15 described above. The above-mentioned shape and positional relation of the voice coil 44, the first magnet 41, and the second magnet 42 prevent the voice coil 44 from contacting with the first magnet 41 or the second magnet 42 even when the diaphragm 45 vibrates largely.

Here, as shown in FIG. 21, the voice coil 44 is adhered in such a manner that the center part of the diaphragm 45 has a convex shape relative to the outer periphery part. Specifically, the center part of the diaphragm 45 located inside the inner periphery shape of the voice coil 44 forms a convex shape. Further, the outer periphery part of the diaphragm 45 located outside the outer periphery shape of the voice coil 44 forms a concave shape. This shape of the diaphragm 45 realizes a shape that the diaphragm 45 hardly contacts with the first magnet 41 and the second magnet 42 at the time of vibration. Thus, even when the electrodynamic electroacoustic transducer is constructed into the same thickness as the conventional one, the first magnet 41 and the second magnet 42 can be made thicker with ensuring the same amplitude margin.

Here, the first magnet 41 is magnetized in the vibrating directions of the diaphragm 45, while the second magnet 42 is magnetized in a circumferential direction (in a direction perpendicular to the vibrating directions). Further, in the yoke 43, a sound hole for emitting sound is formed on the front face side of the electrodynamic electroacoustic transducer 4, while sound holes for releasing pressure are formed on the rear face side. The operation of the electrodynamic electroacoustic transducer 4 is described below.

As described above, a magnetic gap 47 is formed between the first magnet 41 and the second magnet 42. When a signal current flows through the voice coil 44 located in the magnetic gap 47, a driving force is generated that is proportional to the product between the magnitude of the current and the magnetic flux density at the voice coil position. Then, by virtue of the driving force, the diaphragm 45 vibrates and thereby emits sound.

In the electrodynamic electroacoustic transducer 4 of the fourth embodiment, similarly to the first embodiment, the inner diameter of the second magnet 42 is constructed larger than the outer diameter of the first magnet 41. Further, the inner periphery of the voice coil 44 is constructed larger than the outer periphery of the first magnet 41, while the outer periphery of the voice coil 44 is constructed smaller than the inner periphery of the second magnet 42. Thus, even when vibrating largely, the diaphragm 45 does not contact with the voice coil 44, the first magnet 41, or the second magnet 42. Further, the diaphragm 45 has a shape and a position that do not allow easy contact with the first magnet 41 and the second magnet 42 at the time of vibration. Further, in the fourth embodiment, the magnetizing direction of the second magnet 42 is a circumferential direction. Thus, the yoke 13 having been fixed to the upper face of the second magnetic pole 12 in the first embodiment is fixed to the magnetic pole face on the outer periphery side of the second magnet 42. As a result, thickness reduction can be performed further by the amount of the thickness of the yoke. Further, when the electrodynamic electroacoustic transducer is constructed into the same thickness as the first embodiment, the thickness of the second magnet 42 can be made thicker. Further, when the thickness of the second magnet 42 is increased, the magnetic flux increases. At the same time, the permeance coefficient increases even when a high energy product magnet using neodymium or the like is employed. Thus, the magnet becomes more resistive against high temperature demagnetization.

Figure 22:
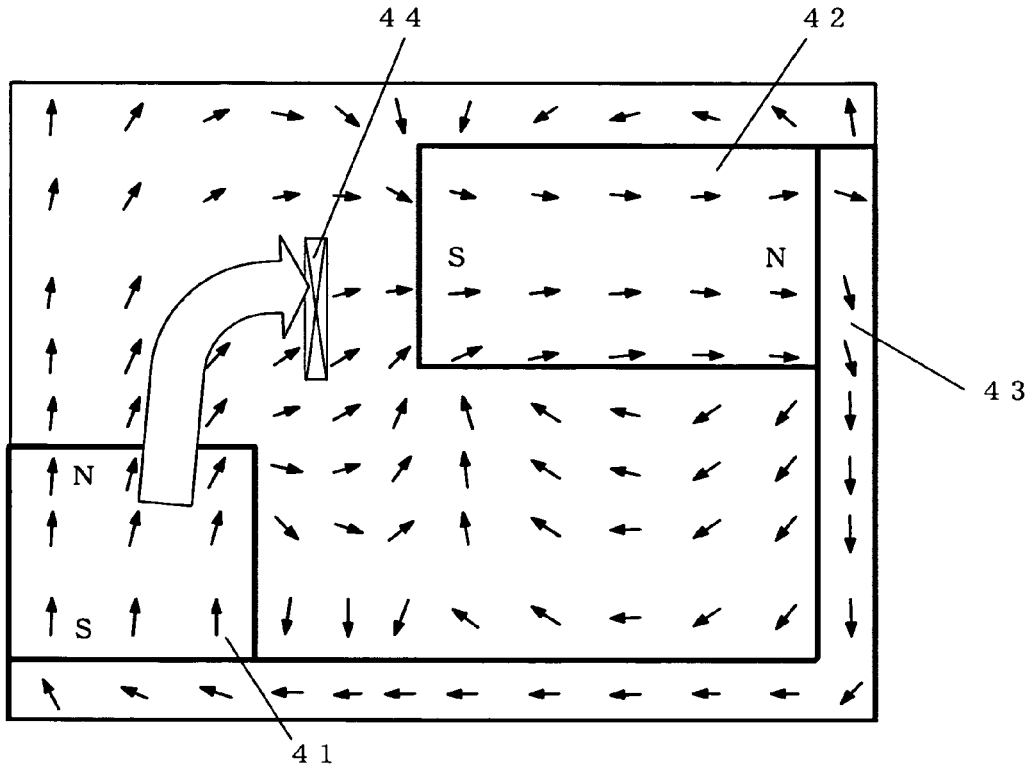
FIG. 22 is a diagram showing the flow of magnetic flux in a vector form, which is obtained in magnetic field analysis by a finite element method performed on an example of a magnetic circuit in an electrodynamic electroacoustic transducer 4 of FIG. 21.

Here, the flow of magnetic flux constructed by the first magnet 41 and the second magnet 42 of the fourth embodiment is described below with reference to FIG. 22. FIG. 22 is a diagram showing the magnetic flux vector obtained in magnetic field analysis by a finite element method performed on an example of a magnetic circuit of the fourth embodiment. As seen from FIG. 22, a magnetic flux is generated that has a directional component perpendicular to the vibrating directions on the voice coil 44. As such, when the first magnet 41 is magnetized in a vibrating direction while the second magnet 42 is magnetized in a circumferential direction, a magnetic flux for driving is formed that has a directional component perpendicular to the vibrating directions.

Here, in the fourth embodiment, the shapes of the first magnet 41, the second magnet 42, and the diaphragm 45 have been circles. Instead, ellipses may be employed. As a result, an electroacoustic transducer can be realized that has a shape suitable for a device in which installation is performed.

Further, the lower face of the second magnet 42 has been located in the front face direction relative to the upper face of the first magnet 41. However, these faces may align in plane. Alternatively, the first magnet 41 may be located in the front face direction.

Figure 23:
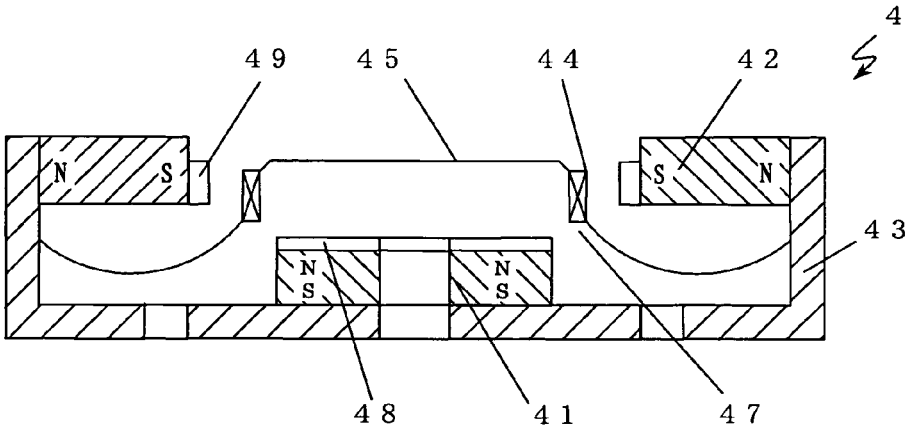
FIG. 23 is a structure sectional view of an electrodynamic electroacoustic transducer 4 of FIG. 21 in a case that plates 48 and 49 are added while a first magnet 41 has a through hole.

Further, as shown in FIG. 23, a first plate 48 may be provided on the upper face of the first magnet 41, while a second plate 49 may be provided on the magnetic pole face on the inner periphery side of the second magnet 42. FIG. 23 is a structure sectional view of an electrodynamic electroacoustic transducer 4 of FIG. 21 in a case that plates 48 and 49 are added while the first magnet 41 has a through hole. The plates 48 and 49 are composed of magnetic materials (such as iron) other than a magnet. In the electrodynamic electroacoustic transducer 4 shown in FIG. 23, the plates are provided so that the magnetic flux is concentrated. Thus, the voice coil can be provided at a more optimal position. In FIG. 23, both of the first magnet 41 and the second magnet 42 have been provided with a plate. Instead, a plate may be provided solely in one of the two magnets, in accordance with the desired thickness or performance of the electroacoustic transducer.

Further, in the fourth embodiment, a magnet of a circular columnar shape has been employed as the first magnet 41. Instead, as shown in FIG. 23, a cylindrical shape may be employed that has a through hole in the center part. That is, the magnet may be an annular body where an open space is formed in the center. When a through hole is provided also in the yoke at the same position as the lower part of the first magnet 41, air under the diaphragm can escape easily.

Fifth Embodiment

Figure 24:
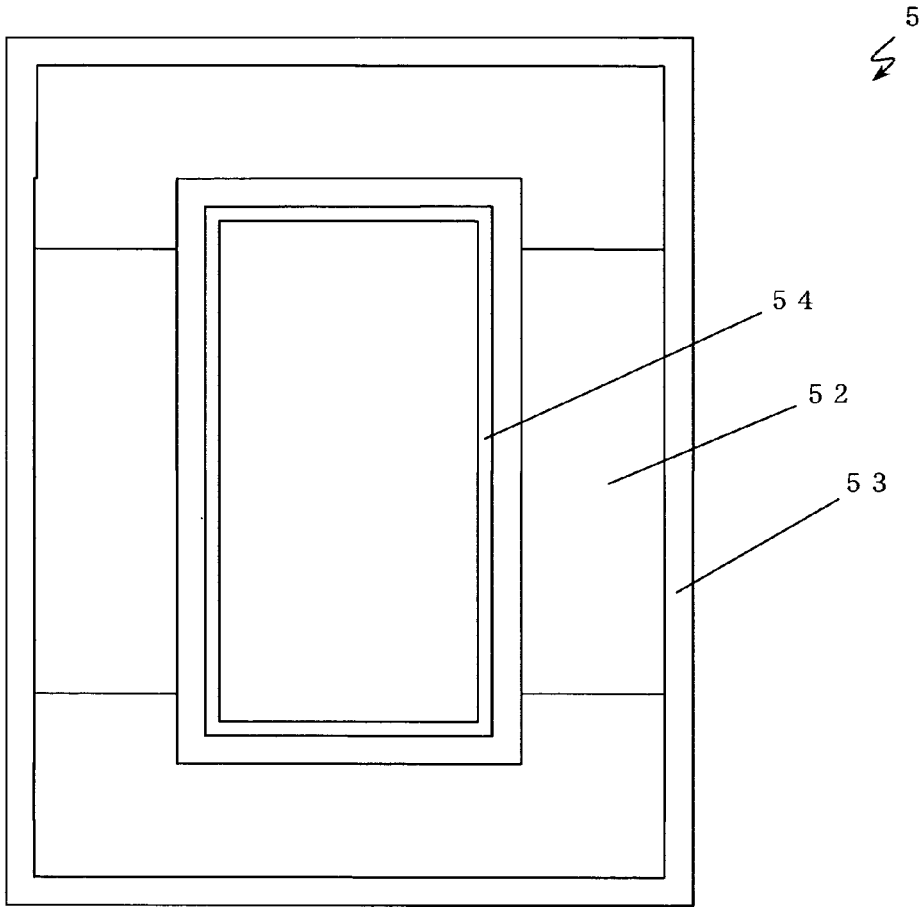
FIG. 24 is a plan view of an electrodynamic electroacoustic transducer 5 according to a fifth embodiment.
Figure 25:
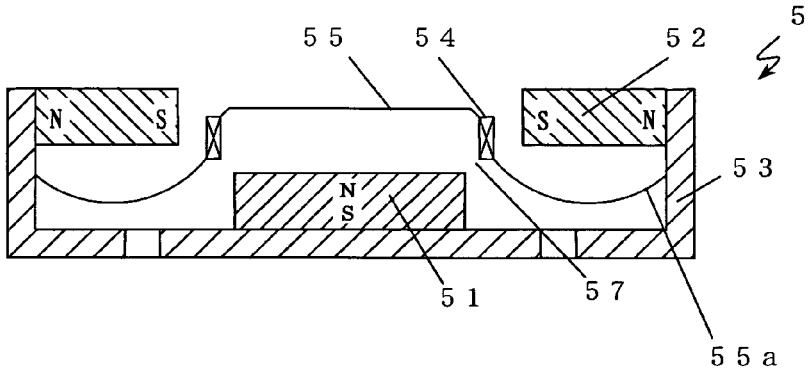
FIG. 25 is a structure sectional view of an electrodynamic electroacoustic transducer 5 according to a fifth embodiment.

An electrodynamic electroacoustic transducer 5 according to a fifth embodiment of the present invention is described below with reference to FIGS. 24 and 25. Here, FIG. 24 is a plan view of an electrodynamic electroacoustic transducer according to the fifth embodiment. FIG. 25 is a structure sectional view of the electrodynamic electroacoustic transducer 5 according to the fifth embodiment. In FIG. 25, the electrodynamic electroacoustic transducer 5 comprises a first magnet 51, a second magnet 52, a yoke 53, a voice coil 54, and a diaphragm 55. Here, as shown in FIG. 24, the shape of the electrodynamic electroacoustic transducer 5 viewed from the vibrating directions is a rectangle. Further, the first magnet 51 is constructed from a magnet having a rectangular parallelepiped (columnar) shape, while the second magnet 52 is constructed from two magnets each having a rectangular parallelepiped shape. Further, the first magnet 51 corresponds to the first magnetic pole part of the present invention, while the second magnet 52 corresponds to the second magnetic pole part of the present invention.

Here, as shown in FIG. 25, the second magnet 52 is located on the front face side of the electrodynamic electroacoustic transducer 5 relative to the first magnet 51. Further, the second magnet 52 is arranged at positions that are symmetric with respect to the center axis of the first magnet 51 and oppose the longer sides of the first magnet 51. Then, the lower face of the second magnet 52 is arranged at the same position as the upper face of the first magnet 51 or alternatively on the front face side of the electrodynamic electroacoustic transducer 5 relative to the upper face. Here, the magnetic gap 57 between the first magnet 51 and the second magnet 52 is formed such as to have a uniform dimension along the longer side part of the first magnet 51.

The yoke 53 fixes respectively the lower face of the first magnet 51 and the magnetic pole face on the outer diameter side of the second magnet 52, and magnetically couples the first magnet 51 and the second magnet 52 so as to support them. The voice coil 54 has a rectangular frame shape as shown in FIG. 24, and is adhered to the diaphragm 55 so as to be retained in the magnetic gap 57 by the diaphragm 55. Further, the inner periphery shape (the inner sides) of the voice coil 54 is constructed larger than the outer periphery shape (the outer sides opposing the inner sides of the voice coil 54) of the first magnet 51. Further, the outer periphery shape (the outer sides) of the voice coil 54 is constructed smaller than the inner periphery shape (the inner sides opposing the outer sides of the voice coil 54) of the second magnet 52. That is, according to the structure of the present embodiment, as shown in FIG. 25, the voice coil 54 does not contact with the first magnet 51 and the second magnet 52 in the vibrating directions. The outer periphery of the diaphragm 55 is fixed to the yoke 53. Then, the diaphragm 55 is arranged such as to be located in an open space formed between the first magnet 51, the second magnet 52, and the yoke 53. Further, the shape of the diaphragm 55 viewed from the vibrating directions is a rectangle. Further, in the diaphragm 55, an edge part 55*a* is formed that is similar to the edge part 15*a* of the diaphragm 15 described above.

Here, the first magnet 51 is magnetized in the vibrating directions, while the second magnet 52 is magnetized in a direction perpendicular to the vibrating directions (in a circumferential direction). Further, in the yoke 53, a sound hole for emitting sound is formed on the front face side of the electrodynamic electroacoustic transducer 5, while sound holes for releasing pressure are formed on the rear face side.

Here, the electrodynamic electroacoustic transducer 5 according to the fifth embodiment is different from the electrodynamic electroacoustic transducer 4 described in the fourth embodiment, only with respect to the shape. Thus, the operation of the electrodynamic electroacoustic transducer 5 is similar to the operation of the electrodynamic electroacoustic transducer 4, and hence detailed description is omitted. Further, in the electrodynamic electroacoustic transducer 5 according to the fifth embodiment, an effect similar to that of the fourth embodiment is obtained.

Here, the outer shape of the electrodynamic electroacoustic transducer 5 viewed from the vibrating directions and the shapes of the first magnet 51, the second magnet 52, and the diaphragm 55 are rectangles. In general, a large number of rectangular spaces are present inside the housing of an electronic device. Thus, since the shape of the electrodynamic electroacoustic transducer 5 viewed from the vibrating directions is a rectangle, the transducer can be installed in a space inside the electronic device without uselessness. That is, in the electrodynamic electroacoustic transducer 5, an improved space utilization factor is achieved in the same space in comparison with the electrodynamic electroacoustic transducer 4 of a circular shape. Further, since the shape of the diaphragm 55 is also a rectangle, a large effective area is ensured. That is, in the electrodynamic electroacoustic transducer 5, the performance is improved by the amount of increase in the effective area of the diaphragm 55.

Further, similarly to the fourth embodiment, the lower face of the second magnet 52 has been located in the front face direction relative to the upper face of the first magnet 51. However, these faces may align in plane. Alternatively, the first magnet 51 may be located in the front face direction.

Further, similarly to the fourth embodiment, a first plate may be provided on the upper face of the first magnet 51, while a second plate may be provided on the magnetic pole face on the inner periphery side of the second magnet 52. When the plates are provided, the magnetic flux is concentrated so that the voice coil can be provided at a more optimal position. At that time, a plate may be provided solely in one of the two magnets in accordance with the desired thickness or performance for the electroacoustic transducer.

Further, although a single magnet of a rectangular parallelepiped shape has been employed in the first magnet 51, two magnets of a rectangular parallelepiped shape may be employed such that a space should be provided in the center part. When a through hole is provided in the yoke at the same position as the lower part of the first magnet 51, air under the diaphragm can escape easily.

Further, the second magnet 52 has been constructed from two magnets each having a rectangular parallelepiped shape. Instead, the second magnet 52 may be constructed from a single annular body magnet. For example, an annular body shape of the magnet 22*a* shown in FIG. 13 may be employed. In this case, a driving force is generated also on the voice coil in the minimum diameter direction similarly in the maximum diameter direction, so that performance is improved.

Further, in the second magnet 52, two more magnets may be provided at positions that oppose the voice coil in the minimum diameter direction, so that an approximately annular body magnet may be constructed from the four magnets. Also in the case, a driving force is generated also on the voice coil in the minimum diameter direction similarly in the maximum diameter direction, so that performance is improved. As such, when the second magnet 52 is constructed from plural pieces, a magnet shape where magnetization is difficult can be realized.

Further, although the outer shape of the electrodynamic electroacoustic transducer 5 viewed from the vibrating directions and the shapes of the first magnet 51, the second magnet 52, and the diaphragm 55 have been rectangles, other polygonal shapes may be employed. Further, shapes in accordance with the inside shape or the application of the electronic components housing may be employed. For example, an elongate quadrangle shape may be employed where two opposing parallel sides are extremely shorter than the other two sides. Further, for example, a shape may be employed where corners or the entirety or a part of sides of a polygonal shape have a roundness.

Sixth Embodiment

Figure 26:
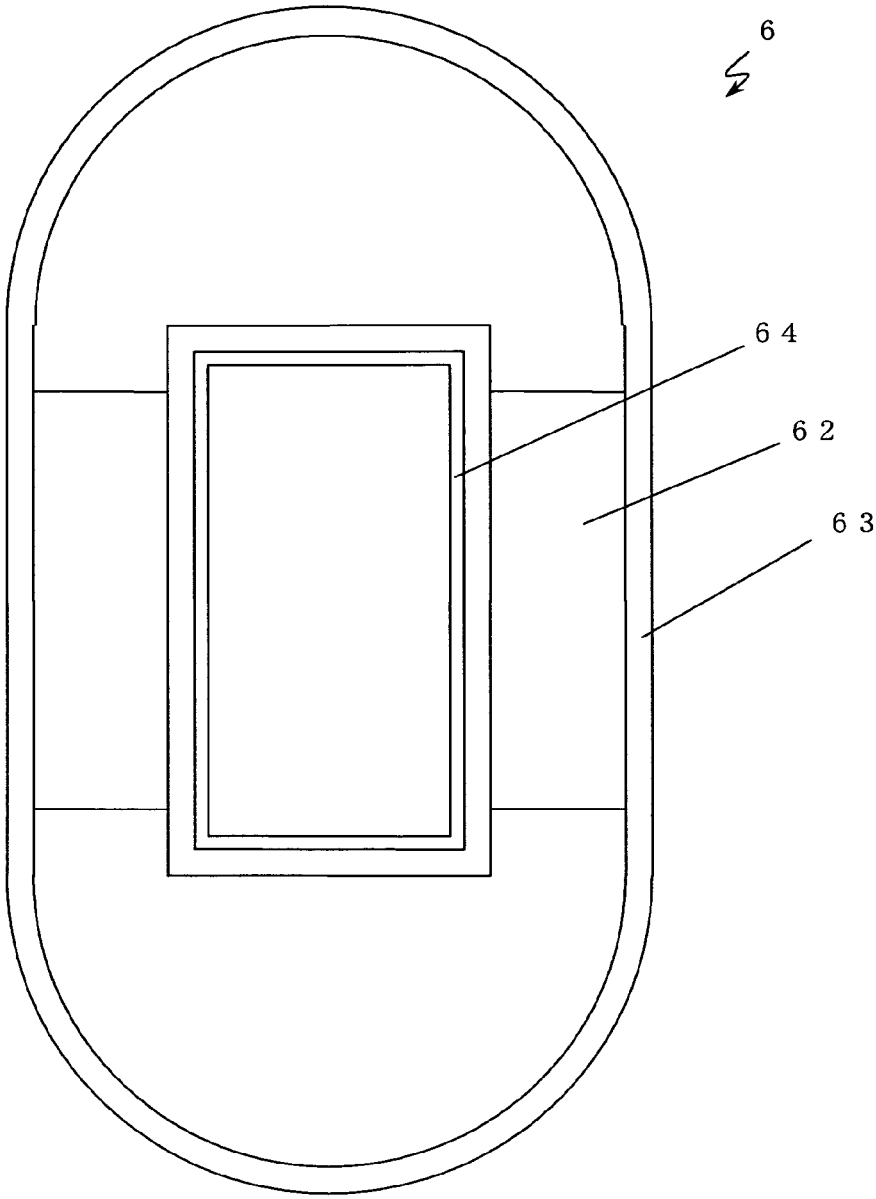
FIG. 26 is a plan view of an electrodynamic electroacoustic transducer 6 according to a sixth embodiment.
Figure 27:
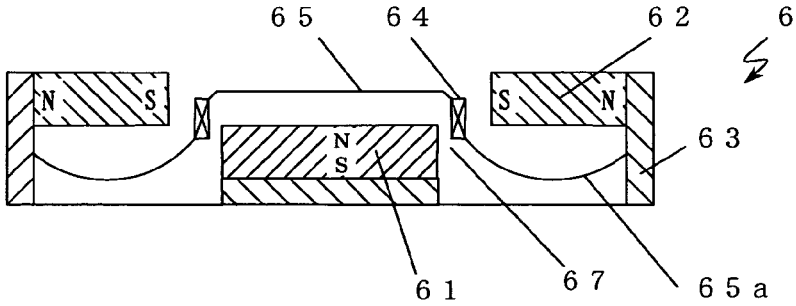
FIG. 27 is a structure sectional view of an electrodynamic electroacoustic transducer 6 according to a sixth embodiment.
Figure 28:
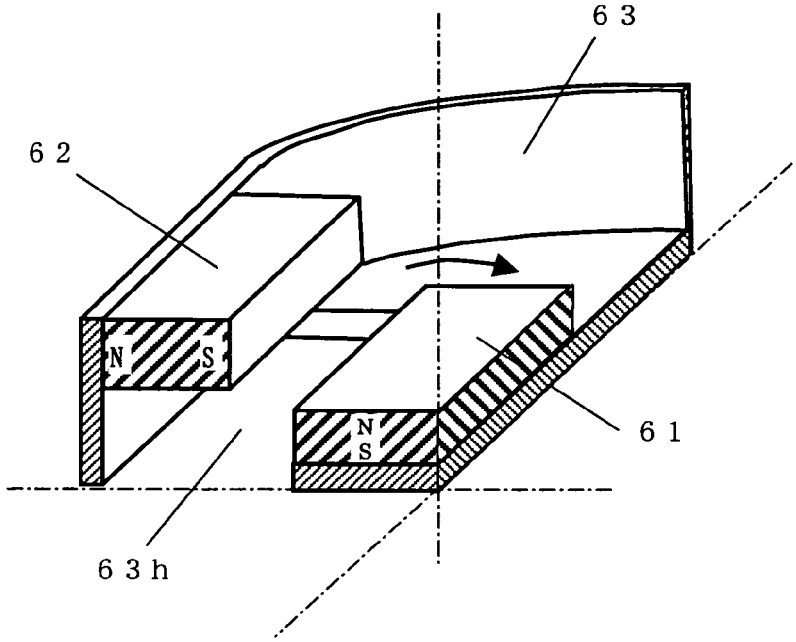
FIG. 28 is a perspective view of a first magnet, a second magnet, and a yoke in an electrodynamic electroacoustic transducer 6.
Figure 29:
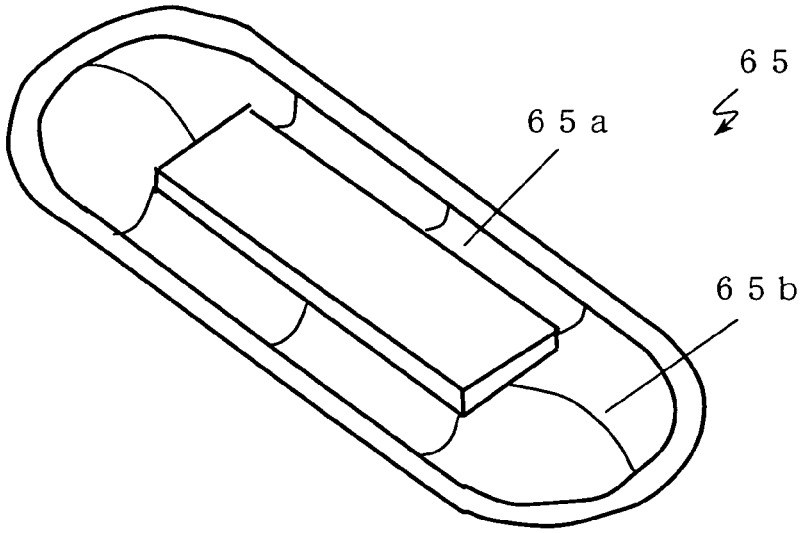
FIG. 29 is a perspective view of a diaphragm in an electrodynamic electroacoustic transducer 6.

An electrodynamic electroacoustic transducer 6 according to a sixth embodiment of the present invention is described below with reference to FIGS. 26-29. Here, FIG. 26 is a plan view of an electrodynamic electroacoustic transducer 6 according to the sixth embodiment. FIG. 27 is a structure sectional view. FIG. 28 is a perspective view of a ¼ model of a first magnet, a second magnet, and a yoke. FIG. 29 is a perspective view of a diaphragm. In FIG. 27, the electrodynamic electroacoustic transducer 6 comprises a first magnet 61, a second magnet 62, a yoke 63, a voice coil 64, and a diaphragm 65. Here, as shown in FIG. 26, the shape of the electrodynamic electroacoustic transducer 6 viewed from the vibrating directions is a track shape. Further, the first magnet 61 corresponds to the first magnetic pole part of the present invention, while the second magnet 62 corresponds to the second magnetic pole part of the present invention.

The magnetic circuit structure of the sixth embodiment is similar to the fifth embodiment with respect to the first magnet 61, the second magnet 62, and the voice coil 64. The first magnet 61 has a rectangular parallelepiped shape, while the second magnet 62 is constructed from two rectangular parallelepiped magnets having a shape in which a curved frame part is removed from an annular body where a rectangular opening is formed in the center part of a track-shaped columnar body. Further, the voice coil 64 has a rectangular shape, and is adhered to the diaphragm 65 so as to be retained in the magnetic gap 67. Further, similarly, the inner periphery shape of the voice coil 64 is constructed larger than the outer periphery shape of the first magnet 61, while the outer periphery shape of the voice coil 64 is constructed smaller than the inner periphery shape of the second magnet 62. Furthermore, similarly, the magnetizing directions of the first magnet 61 and the second magnet 62 are respectively in a vibrating direction and in a direction perpendicular to the vibrating directions.

As for the yoke 63 and the diaphragm 65, the present embodiment differs from the fifth embodiment described above. The outer periphery shapes of the yoke 63 and the diaphragm 65 are track shapes. Further, as shown in FIGS. 27 and 28, in the yoke 63, a part that is located on the outer periphery side of the longer side part of the first magnet 61 and that opposes the second magnet 62 is cut off. That is, in the yoke 63, an opening 63*h* is formed in a part opposing the second magnet 62. The opening 63*h* is formed in a size that includes at least the part opposing the second magnet 62. Here, similarly to the fifth embodiment described above, the yoke 63 magnetically couples the lower face of the first magnet 61 and the magnetic pole face on the outer periphery side of the second magnet 62 so as to support them. However, as shown in FIG. 28, the magnetic flux having flowed through the above-mentioned opening 63*h* in the fifth embodiment flows through the yoke 63 of the part indicated by an arrow, in the sixth embodiment. As such, the magnetic paths differ from each other in the sixth embodiment and the fifth embodiment. Further, as shown in FIG. 29, in the diaphragm 65, edge parts located outside the outer periphery part of the voice coil 64 are formed in accordance with the shape of the yoke 63. That is, an edge part 65*a* where the yoke 63 is not present in the lower face of the edge part forms a concave shape (a convex shape toward the opening 63*h*) when viewed from the upper face. An edge part 65*b* where the yoke 63 is present in the lower face of the edge part forms a convex shape (a concave shape toward the yoke 63 side on the lower face of the edge) when viewed from the upper face. Here, the edge parts 65*a* and 65*b* may be constructed integrally with the diaphragm 65 other than the edge parts 65*a* and 65*b*, or alternatively may be constructed separately.

Here, the electrodynamic electroacoustic transducer 6 according to the sixth embodiment is different from the electrodynamic electroacoustic transducer 4 described in the fourth embodiment, only with respect to the shapes of the respective parts. Thus, the operation of the electrodynamic electroacoustic transducer 6 is similar to the operation of the electrodynamic electroacoustic transducer 4, and hence detailed description is omitted. Further, in the electrodynamic electroacoustic transducer 6 according to the sixth embodiment, an effect similar to that of the fourth embodiment is obtained.

Here, the outer shape of the electrodynamic electroacoustic transducer 6 according to the present embodiment and the shape of the diaphragm 65 viewed from the vibrating directions are track shapes. That is, since the electrodynamic electroacoustic transducer 6 and the diaphragm 65 are not of a circular shape, space utilization efficiency is improved similarly to the fifth embodiment. Further, in contrast to the fifth embodiment where the rectangular shape has caused an increase in the edge stiffness in the corner part, the structure according to the sixth embodiment employs curves so that the entire stiffness is maintained in a good balance. Thus, according to the sixth embodiment, easy vibration is allowed in the corner part in comparison with the rectangular diaphragm, so that an electroacoustic transducer is realized in which distortion is reduced in a low pitch sound range.

Further in the sixth embodiment, the yoke 63 of a part opposing the second magnet 62 is cut off, while the yoke 63 of a part not opposing the second magnet 62 is not cut off and serves as a part of the magnetic path. In correspondence to this, the edge on the minor diameter side of the diaphragm 65 is formed in a concave shape toward the vibrating directions, while the edge on the major diameter side is formed in a convex shape, so that these edges are constructed such as not to contact with the second magnet 62 and the yoke 63, respectively. As a result, the second magnet 62 can be provided more downward by the amount of the thickness of the yoke 63. Thus, the distance between the first magnet 61 and the second magnet 62 is reduced so that the magnetic flux density generated in the magnetic gap 67 becomes large. Thus, a thin electroacoustic transducer of high performance is obtained.

Here, in the sixth embodiment, the upper face of the first magnet 61 and the lower face of the second magnet 62 have been located in plane. However, any one of these may be located in the front face direction.

Further, similarly to the fourth embodiment, a first plate may be provided on the upper face of the first magnet 61, while a second plate may be provided on the magnetic pole face on the inner periphery side of the second magnet 62. When the plates are provided, the magnetic flux is concentrated so that the voice coil can be provided at a more optimal position. At that time, a plate may be provided solely in one of the two magnets in accordance with the desired thickness or performance for the electroacoustic transducer.

Further, although a single magnet of a rectangular parallelepiped shape has been employed in the first magnet 61, two magnets of a rectangular parallelepiped shape may be employed such that a space should be provided in the center part. When a through hole is provided in the yoke 63 at the same position as the lower part of the first magnet 61, air under the diaphragm can escape easily.

Further, the shape of the voice coil has been a rectangle. Instead, a track shape similar to the diaphragm shape may be employed.

Seventh Embodiment

Figure 30:
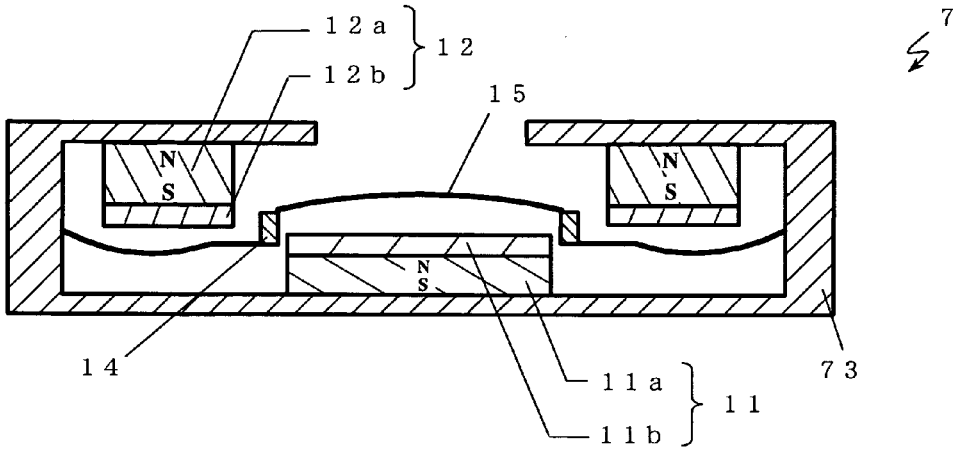
FIG. 30 is a structure sectional view of an electrodynamic electroacoustic transducer 7 according to a seventh embodiment.
Figure 31:
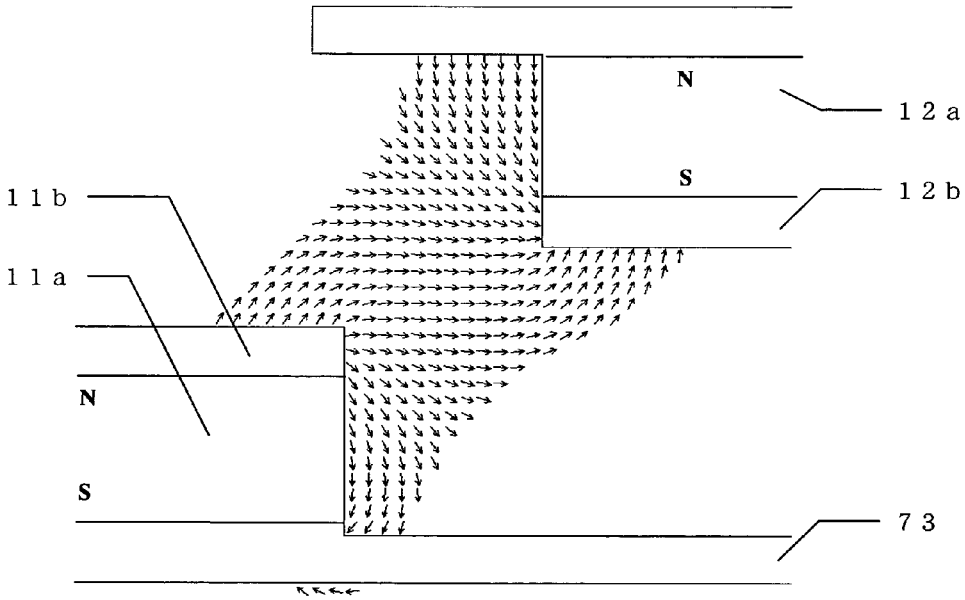
FIG. 31 is a diagram showing the flow of magnetic flux in a vector form, which is obtained in magnetic field analysis by a finite element method performed on an example of a magnetic circuit in an electrodynamic electroacoustic transducer 7 of FIG. 30.
Figure 32:
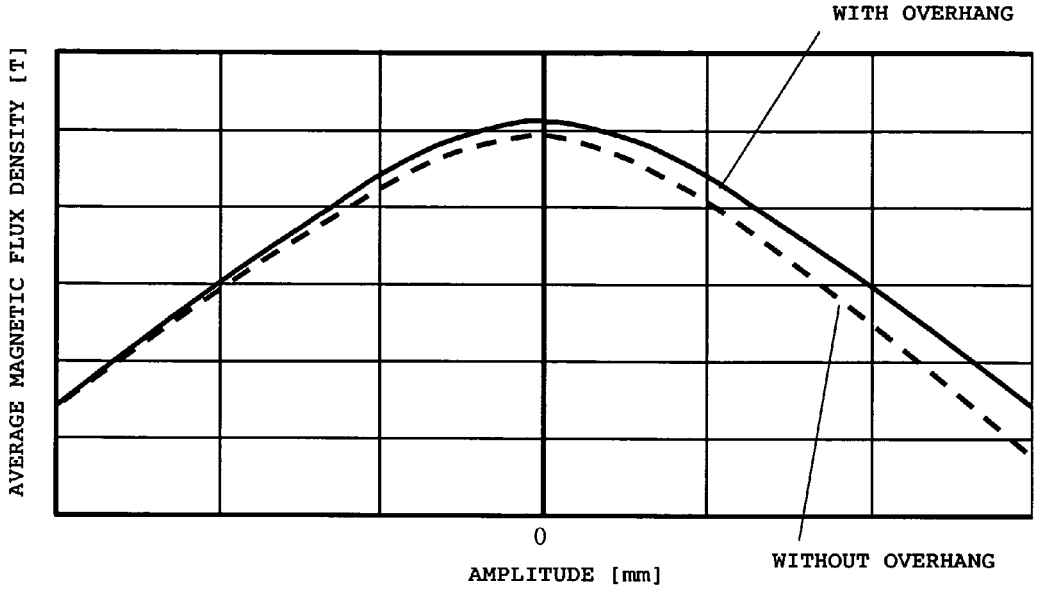
FIG. 32 is a diagram showing, in the form of a curve, a magnetic flux density at each voice coil position of an electrodynamic electroacoustic transducer 1 and an electrodynamic electroacoustic transducer 7.

An electrodynamic electroacoustic transducer 7 according to a seventh embodiment of the present invention is described below with reference to FIGS. 30-32. FIG. 30 is a structure sectional view of an electrodynamic electroacoustic transducer 7 according to the seventh embodiment. FIGS. 31 and 32 are described later. In FIG. 30, the electrodynamic electroacoustic transducer 7 comprises a first magnetic pole 11, a second magnetic pole 12, a yoke 73, a voice coil 14, and a diaphragm 15. Here, the first magnetic pole 11, the second magnetic pole 12, the voice coil 14, and the diaphragm 15 are similar to the respective parts of the first embodiment described above. Thus, they are designated by the same numerals, and their description is omitted.

As shown in FIG. 30, the electrodynamic electroacoustic transducer 7 is a transducer in which the yoke has a different structure from that of the electrodynamic electroacoustic transducer 1 described above. Specifically, the yoke 73 is constructed such as to hang over from the inner diameter of the second magnetic pole 12 toward the inside in a part to which the second magnetic pole 12 is adhered. That is, the sound hole formed on the front face side of the electrodynamic electroacoustic transducer 7 becomes a sound hole having an inner diameter smaller than that of the first embodiment by virtue of the yoke 73. Here, this structure is possible only when the thickness of the second magnetic pole 12 is sufficiently thick so that the diaphragm 15 contacts with the second magnetic pole 12 before contacting with the overhang part of the yoke 73.

The flow of magnetic flux between the first magnetic pole 11 and the second magnetic pole 12 is a flow as indicated by an arrow in FIG. 31. Here, FIG. 31 is a diagram showing the flow of magnetic flux in a vector form, which is obtained in magnetic field analysis by a finite element method performed on an example of a magnetic circuit of the present embodiment. Further, when the magnetic flux density at the voice coil position is compared between the electrodynamic electroacoustic transducer 1 and the electrodynamic electroacoustic transducer 7, the result is as shown in FIG. 32. FIG. 32 is a diagram showing, in the form of a curve, the magnetic flux density at each voice coil position of an electrodynamic electroacoustic transducer 1 and an electrodynamic electroacoustic transducer 7. That is, FIG. 32 is a diagram in which the magnetic flux density at the voice coil position is compared between the case that the yoke has an overhang (the electrodynamic electroacoustic transducer 7 employing the yoke 73) and the case that the yoke has no overhang (the electrodynamic electroacoustic transducer 1 employing the yoke 13).

As shown in FIG. 32, the magnetic flux density at the voice coil position becomes large in the case of presence of an overhang, so that a larger driving force is obtained than in the case of absence of an overhang. That is, a larger driving force is obtained in the structure of the electrodynamic electroacoustic transducer 7 than in the structure of the electrodynamic electroacoustic transducer 1.

Further, since the overhang part is provided in the yoke 73, the magnetic circuit constructed from the first magnetic pole 11 and the yoke 73 of the part to which the first magnetic pole 11 is adhered and the magnetic circuit constructed from the second magnetic pole 12 and the yoke 73 of the part to which the second magnetic pole 12 is adhered have a configuration approximately in up-and-down symmetry with reference to the voice coil 14. Thus, as shown in FIG. 32, the magnetic flux density curve in the case of presence of an overhang becomes more line symmetric with respect to the axis of amplitude 0 than the curve in the case of absence of an overhang. As a result, in the electrodynamic electroacoustic transducer 7, distortion in the reproduced sound is reduced in comparison with the electrodynamic electroacoustic transducer 1.

Figure 33:
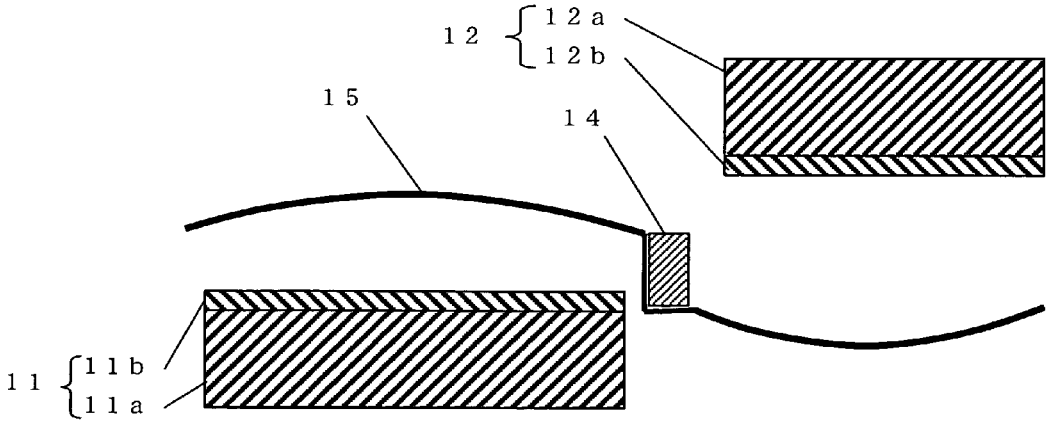
FIG. 33 is a diagram showing an example of a shape of a diaphragm in an adhesion part between the diaphragm and a voice coil.
Figure 34:
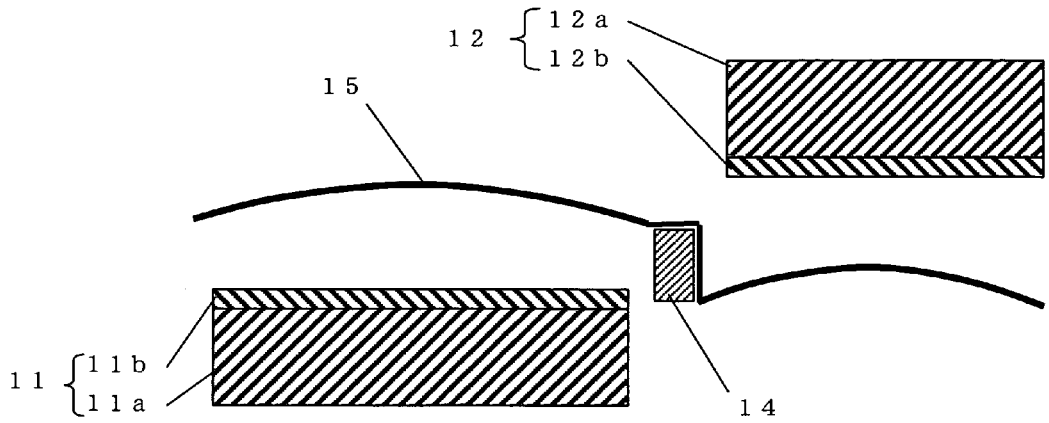
FIG. 34 is a diagram showing another example of a shape of a diaphragm in an adhesion part between the diaphragm and a voice coil.

Here, the diaphragm (15, 25, 35, 45, 55, and 65) of the first through the seventh embodiments described above has a shape, for example, shown in FIGS. 33 and 34 in an adhesion part between the diaphragm and the voice coil (14, 24, 34, 44, 54, and 64). Specifically, the shape of the diaphragm is a shape that a part opposing the upper face of the first magnetic pole is located above the lower end of the voice coil while a part opposing the lower face of the second magnetic pole is located below the upper end of the voice coil. Here, FIG. 33 is a diagram showing an example of the shape of a diaphragm in an adhesion part between the diaphragm and a voice coil. FIG. 34 is a diagram showing another example of the shape of a diaphragm in an adhesion part between the diaphragm and a voice coil. In FIG. 33, the voice coil 14 is adhered to the diaphragm 15 in such a manner that the lower face of the voice coil 14 should be arranged on the upper face of the diaphragm 15. Further, in FIG. 34, the voice coil 14 is adhered to the diaphragm 15 in such a manner that the upper face of the voice coil 14 should be arranged on the lower face of the diaphragm 15.

Figure 35:
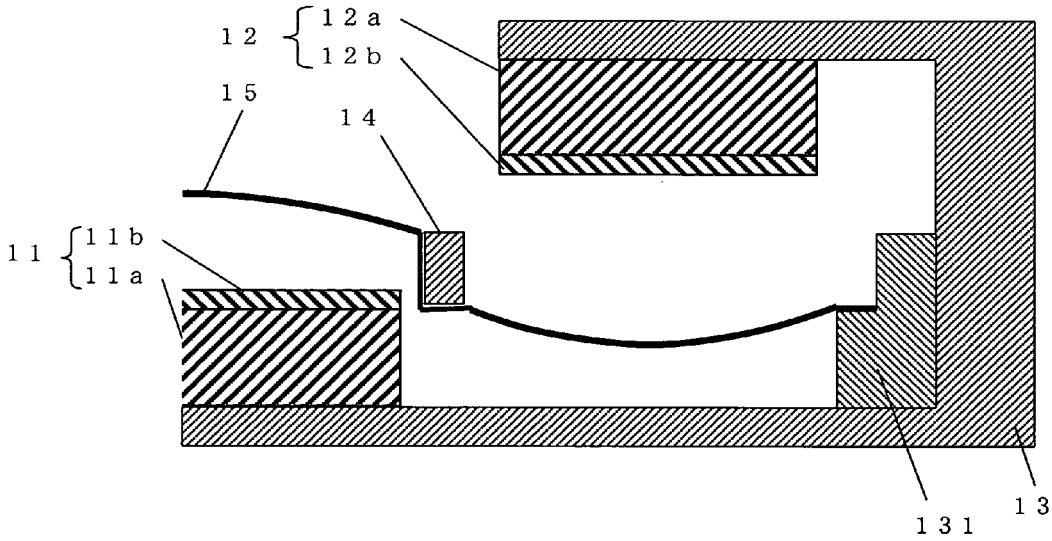
FIG. 35 is a diagram showing an example in which an outer periphery of a diaphragm 15 is fixed to a support body 131.

Here, in the diaphragm (15, 25, 35, 45, 55, and 65) of the first through the seventh embodiments described above, the outer periphery has been assumed to be fixed to the yoke. However, the present invention is not limited to this. For example, as shown in FIG. 35, the structure may be such that a support body 131 may be fixed to the yoke 13 while the outer periphery of the diaphragm 15 is fixed to the support body 131. FIG. 35 is a diagram showing an example in which the outer periphery of the diaphragm 15 is fixed to the support body 131. Here, the support body may be constructed from a magnetic material, or alternatively may be constructed from a non-magnetic material.

Here, the electrodynamic electroacoustic transducer according to the first through the seventh embodiments described above may be implemented by installing in an electronic device such as a mobile device, an AV device, and a video device. Such mobile devices include a portable telephone, a PDA (Personal digital assistant), a personal computer, and a portable music player. AV devices include a television receiver, an audio device, and a car audio device. Video devices include a television receiver having a PDP (Plasma display panel), a liquid crystal display, or a cathode-ray tube. Specific examples are described below in which an electrodynamic electroacoustic transducer according to the present invention is installed in a portable telephone or a flat television receiver such as a PDP. Further, a specific example is also described below in which an electrodynamic electroacoustic transducer according to the present invention is installed as a car audio device into the door of an automobile.

Figure 36:
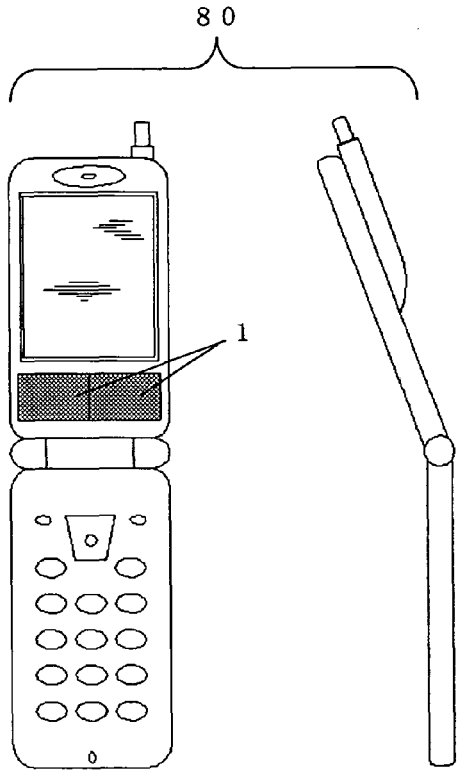
FIG. 36 is a front view and a side view showing an example of an electrodynamic electroacoustic transducer 1 installed in a portable telephone 80.

First, an example in which an electrodynamic electroacoustic transducer according to the present invention is fixed inside the housing of a portable telephone 80 is described below with reference to FIG. 36. FIG. 36 is a front view and a side view showing an example of an electrodynamic electroacoustic transducer 1 installed in a portable telephone 80. In FIG. 36, for example, the electrodynamic electroacoustic transducer 1 described above is assumed to be fixed inside the housing of the portable telephone 80. The electrodynamic electroacoustic transducer 1 is fixed in each of the right and left in the inside of the housing in the lower part of the liquid crystal display of portable telephone 80.

Here, in recent years, in mobile devices such as portable telephones, thickness reduction and size reduction are desired. In association with this, thickness reduction and size reduction are desired also in the electrodynamic electroacoustic transducer installed inside the housing. At this time, in the electrodynamic electroacoustic transducer 1 according to the present invention as described above, when the same amplitude margin as the conventional one is ensured, the thickness of the transducer itself can be reduced in comparison with a conventional art electrodynamic electroacoustic transducer. As a result, according to the electrodynamic electroacoustic transducer of the present invention, an electrodynamic electroacoustic transducer can be provided that is optimal in being installed in a mobile device such as a portable telephone.

Figure 37:
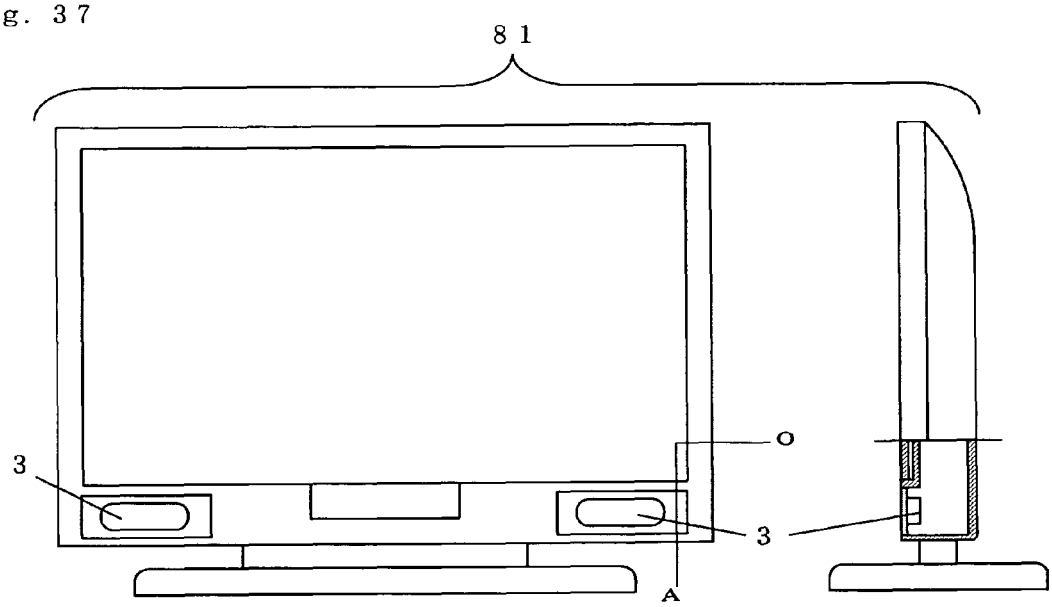
FIG. 37 is a front view showing an example of an electrodynamic electroacoustic transducer 3 installed in a flat television receiver 81 and a side view showing an internal structure of a part of a flat television receiver 81 in the form of a cross section taken along line O-A.

Next, an example in which an electrodynamic electroacoustic transducer according to the present invention is fixed inside the housing of a flat television receiver 81 such as a PDP where thickness reduction is advancing is described below with reference to FIG. 37. FIG. 37 is a front view showing an example of an electrodynamic electroacoustic transducer 3 installed in a flat television receiver 81 and a side view showing an internal structure of a part of a flat television receiver 81 in the form of a cross section taken along line O-A. In FIG. 37, for example, the electrodynamic electroacoustic transducer 3 described above is assumed to be fixed inside the housing of the flat television receiver 81. The electrodynamic electroacoustic transducer 3 is fixed in each of the right and left in the inside of the housing of the flat television receiver 81.

Here, in recent years, in video devices such as a flat television receiver 81, thickness reduction is desired. In association with this, thickness reduction is desired also in the electrodynamic electroacoustic transducer installed inside the housing. At that time, in the electrodynamic electroacoustic transducer 3 according to the present invention as described above, when the same amplitude margin as the conventional one is ensured, the thickness of the transducer itself can be reduced in comparison with a conventional art electrodynamic electroacoustic transducer. As a result, according to the electrodynamic electroacoustic transducer of the present invention, an electrodynamic electroacoustic transducer can be provided that is optimal in being installed in a video device such as a flat television receiver 81.

Figure 38:
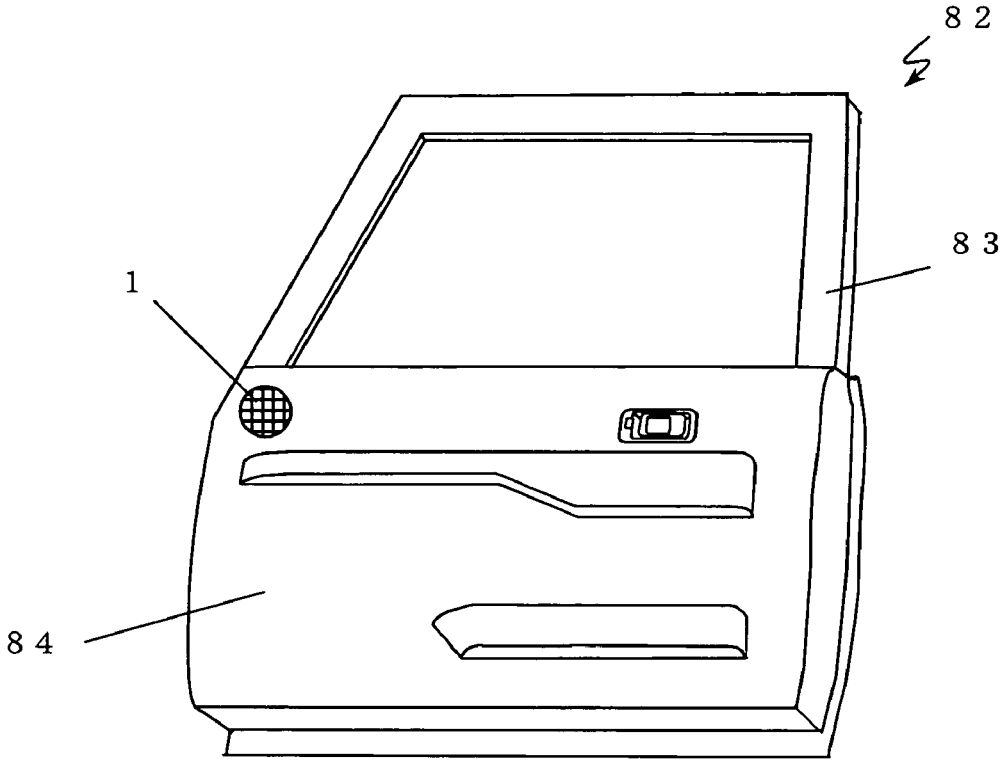
FIG. 38 is a diagram showing an example of an electrodynamic electroacoustic transducer 1 installed in a door 82 of an automobile.

Next, an example in which an electrodynamic electroacoustic transducer according to the present invention is fixed to a main body 84 of a door 82 of an automobile is described below with reference to FIG. 38. FIG. 38 is a diagram showing an example of an electrodynamic electroacoustic transducer 1 installed in a door 82 of an automobile. In FIG. 38, a door 82 of an automobile is constructed from a window part 83 and a main body 84. Then, for example, the electrodynamic electroacoustic transducer 1 described above is assumed to be fixed to the main body 84. The main body 84 is a housing having an internal space.

Here, in the internal space of the main body 84 of the door 82, the space for installing the electrodynamic electroacoustic transducer is a remarkably narrow space. However, in the electrodynamic electroacoustic transducer 1 according to the present invention as described above, when the same amplitude margin as the conventional one is ensured, the thickness of the transducer itself can be reduced in comparison with a conventional art electrodynamic electroacoustic transducer. As a result, according to the electrodynamic electroacoustic transducer of the present invention, an electrodynamic electroacoustic transducer can be provided that is optimal in being installed in a door 82 of an automobile.

Further, an automobile is located under various kinds of environment. Thus, remarkably high temperature reliability is required in an electronic device installed in the automobile. At that time, in the electrodynamic electroacoustic transducer according to the present invention as described above, when the same thickness as the conventional one is adopted, the magnet can be made thick in comparison with the conventional art. Further, the permeance coefficient increases even when a high energy product magnet using neodymium or the like is employed. Thus, the magnet becomes more resistive against high temperature demagnetization than in the conventional art. That is, the electrodynamic electroacoustic transducer according to the present invention has higher temperature reliability than in the conventional art. Thus, the electrodynamic electroacoustic transducer according to the present invention is an electrodynamic electroacoustic transducer which is more optimal in being installed in an automobile.

INDUSTRIAL APPLICABILITY

The electrodynamic electroacoustic transducer according to the present invention is applicable to all electronic devices having an electroacoustic transducer, and is in particular useful for mobile devices such as a portable telephone and a PDA where size reduction and thickness reduction of the electroacoustic transducer are necessary. Further, the present invention is applicable to a display that requires an electroacoustic transducer having an elongate rectangular shape, and the like.

The invention claimed is:

1. An electrodynamic electroacoustic transducer comprising:

a first magnetic pole part formed by at least one three-dimensional body;

a second magnetic pole part which is formed by at least one three-dimensional body, forms a magnetic gap between itself and the first magnetic pole part, and is arranged in a space excluding spaces in upper and lower face directions of the first magnetic pole part;

a yoke for magnetically coupling one magnetic pole face of the first magnetic pole part with one magnetic pole face of the second magnetic pole part so as to support them;

a diaphragm which is arranged in a space in an upper face direction of the first magnetic pole part and in a space in a lower face direction of the second magnetic pole part, has an outer periphery supported by the yoke, and can vibrate in up and down directions; and a voice coil adhered to the diaphragm and arranged in the magnetic gap, wherein an inner periphery shape of the voice coil is larger than an outer periphery shape of the first magnetic pole part, and the outer periphery shape of the voice coil is smaller than an inner periphery shape of the second magnetic pole part, wherein each of the first magnetic pole part and the second magnetic pole part includes a magnet, and the magnet included in the first magnetic pole part and the magnet included in the second magnetic pole part are magnetized into the same polarity in the vibrating directions of the diaphragm, wherein the first magnetic pole part and the second magnetic pole part generate, within the voice coil, magnetic fluxes perpendicular to the vibrating directions of the diaphragm, and wherein the diaphragm includes an edge part that permits vibration of the diaphragm, while at least a part of the edge part opposes a lower face of the second magnetic pole part.

2. The electrodynamic electroacoustic transducer as claimed in claim 1, wherein in the vibrating directions of the diaphragm, the lower face of the second magnetic pole part is located above the upper face of the first magnetic pole part.

3. The electrodynamic electroacoustic transducer as claimed in claim 1, wherein in the vibrating directions of the diaphragm, the lower face of the second magnetic pole part it is located below the upper face of the first magnetic pole part or alternatively in plane with the upper face of the first magnetic pole part.

4. The electrodynamic electroacoustic transducer as claimed in claim 1, wherein the first magnetic pole part and the second magnetic pole part are annular bodies in which an open space is formed in a center, and wherein the first magnetic pole part is arranged in a space in up and down directions of the open space of the annular body that constitutes the second magnetic pole part.

5. The electrodynamic electroacoustic transducer as claimed in claim 1, wherein the first magnetic pole part is a columnar body, wherein the second magnetic pole part is an annular body in which an open space is formed in a center, and wherein the first magnetic pole part is arranged in a space in up and down directions of the open space of the annular body that constitutes the second magnetic pole part.

6. The electrodynamic electroacoustic transducer as claimed in claim 1, wherein the voice coil has two straight line parts where portions of a winding part face to each other, wherein the first magnetic pole part includes at least one rectangular parallelepiped including a magnet and having sides each parallel to each of the two straight line parts, wherein the second magnetic pole part includes two rectangular parallelepipeds each including a magnet, and wherein in the voice coil, one of the straight line parts is arranged in a magnetic gap formed between one of the second magnetic pole parts and the first magnetic pole part, while the other one of the straight line parts is arranged in a magnetic gap formed between the other one of the second magnetic pole parts and the first magnetic pole part.

7. The electrodynamic electroacoustic transducer as claimed in claim 6, wherein the first magnetic pole part includes two rectangular parallelepipeds each having sides each parallel to each of the two straight line parts and including a magnet.

8. The electrodynamic electroacoustic transducer as claimed in claim 1, wherein at least one of the first magnetic pole part and the second magnetic pole part is constructed from: a plate composed of a magnetic material not including a magnet; and the magnet in which two magnetic pole faces are formed, and wherein the yoke is coupled to one magnetic pole face of the magnet, while the plate is adhered to the other magnetic pole face of the magnet.

9. The electrodynamic electroacoustic transducer as claimed in claim 1, wherein in the diaphragm, a shape of a part opposing the upper face of the first magnetic pole part is formed in a convex shape relative to the other parts.

10. The electrodynamic electroacoustic transducer as claimed in claim 1, wherein the voice coil is adhered to either the upper face side or the lower face side of the diaphragm, and wherein the diaphragm is formed in a shape such that a part opposing the upper face of the first magnetic pole part should be located above a lower end of the voice coil, and that a part opposing the lower face of the second magnetic pole part should be located below an upper end of the voice coil.

11. The electrodynamic electroacoustic transducer as claimed in claim 1, wherein the diaphragm is formed in a shape selected from a group consisting of a circle, a rectangle, an ellipse, a polygon, and a shape in which two opposing sides in a rectangle or a polygon are solely formed by semicircles.

12. An electronic device in which an electrodynamic electroacoustic transducer is installed, wherein the electrodynamic electroacoustic transducer comprises:

a first magnetic pole part formed by at least one three-dimensional body;

a second magnetic pole part which is formed by at least one three-dimensional body, forms a magnetic gap between itself and the first magnetic pole part, and is arranged in a space excluding spaces in upper and lower face directions of the first magnetic pole part;

a yoke for magnetically coupling one magnetic pole face of the first magnetic pole part with one magnetic pole face of the second magnetic pole part so as to support them;

a diaphragm which is arranged in a space in an upper face direction of the first magnetic pole part and in a space in a lower face direction of the second magnetic pole part, has an outer periphery supported by the yoke, and can vibrate in up and down directions; and a voice coil adhered to the diaphragm and arranged in the magnetic gap, wherein an inner periphery shape of the voice coil is larger than an outer periphery shape of the first magnetic pole part, and the outer periphery shape of the voice coil is smaller than an inner periphery shape of the second magnetic pole part, wherein each of the first magnetic pole part and the second magnetic pole part includes a magnet, and the magnet included in the first magnetic pole part and the magnet included in the second magnetic pole part are magnetized into the same polarity in the vibrating directions of the diaphragm, wherein the first magnetic pole part and the second magnetic pole part generate, within the voice coil, magnetic fluxes perpendicular to the vibrating directions of the diaphragm, and wherein the diaphragm includes an edge part that permits vibration of the diaphragm, while at least a part of the edge part opposes a lower face of the second magnetic pole part.

* * * * *